US011829088B2

(12) United States Patent
Kobayashi

(10) Patent No.: US 11,829,088 B2
(45) Date of Patent: Nov. 28, 2023

(54) IMAGE FORMING APPARATUS USING DOUBLE-SIDED TEST CHART

(71) Applicant: CANON KABUSHIKI KAISHA, Tokyo (JP)

(72) Inventor: Manato Kobayashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/729,631

(22) Filed: Apr. 26, 2022

(65) Prior Publication Data

US 2022/0357693 A1 Nov. 10, 2022

(30) Foreign Application Priority Data

May 7, 2021 (JP) ..... 2021-079387

(51) Int. Cl.
*G03G 15/16* (2006.01)
*G03G 15/00* (2006.01)
*G03G 15/23* (2006.01)

(52) U.S. Cl.
CPC ..... *G03G 15/1675* (2013.01); *G03G 15/234* (2013.01); *G03G 15/5058* (2013.01); *G03G 15/5062* (2013.01)

(58) Field of Classification Search
CPC ..... G03G 15/1675; G03G 15/234; G03G 15/5062; G03G 15/5058
See application file for complete search history.

(56) References Cited

U.S. PATENT DOCUMENTS 8,447,217 B2 * 5/2013 Mori ..... G03G 15/235 399/314
8,681,371 B2 * 3/2014 Hirose ..... G06K 15/027 358/1.9
8,843,003 B2 9/2014 Nakao
10,585,376 B2 3/2020 Murayama et al.
10,990,051 B2 4/2021 Omata et al.
10,990,860 B2 * 4/2021 Song ..... G03G 15/5058
11,126,115 B2 * 9/2021 Sueoka ..... G03G 15/1675
2010/0067925 A1 * 3/2010 Mori ..... G03G 15/5025 399/15

(Continued)

FOREIGN PATENT DOCUMENTS

JP 4285733 B2 * 6/2009
JP 2010-072326 A 4/2010

(Continued)

*Primary Examiner* — Arlene Heredia
(74) *Attorney, Agent, or Firm* — Venable LLP

(57) ABSTRACT

An image forming apparatus includes an image forming portion, a transfer portion, a power source, a reading portion, and a controller. The controller executes an output operation so that first test images do not overlap with second test images, respectively, on a first side and a second side of a recording material. On the basis of information on a second test voltage for transfer of the second test image, of the plurality of second test images, of which information on a density read by the reading portion coincides with a preset condition, the controller sets a transfer voltage for image transfer onto the second side in double side image formation so that an absolute value of the transfer voltage set for the image transfer onto the second side in double side image formation is greater than an absolute value of the second test voltage that coincides with the preset condition.

4 Claims, 15 Drawing Sheets

(a) (b)

(56) References Cited

U.S. PATENT DOCUMENTS

| | | | | |
|---|---|---|---|---|
| 2013/0039673 | A1* | 2/2013 | Nakao | G03G 15/5062 399/49 |
| 2016/0052317 | A1* | 2/2016 | Kyoso | B41J 29/38 347/19 |
| 2020/0166881 | A1* | 5/2020 | Omata | G03G 15/5062 |
| 2022/0019166 | A1* | 1/2022 | Seki | G03G 15/5058 |

FOREIGN PATENT DOCUMENTS

| | | | |
|---|---|---|---|
| JP | 2013-037185 | A | 2/2013 |
| JP | 2019-066804 | A | 4/2019 |
| JP | 2020-086107 | A | 6/2020 |

* cited by examiner

| | | AMBIENT WATER CONTENT (g/kg) | | | | |
|---|---|---|---|---|---|---|
| | | 0.9 ≥ | ··· | 8.9 | ··· | 21.5 ≤ |
| BASIS WEIGHT ($g/m^2$) | · | · | | · | | · |
| | · | · | | · | | · |
| | 81～100 | 1000V | ··· | 500V | ··· | 200V |
| | 101～125 | 1150V | ··· | 600V | ··· | 250V |
| | 126～150 | 1300V | ··· | 700V | ··· | 300V |
| | · | · | | · | | · |
| | · | · | | · | | · |

Fig. 5

IMAGE FORMING APPARATUS USING DOUBLE-SIDED TEST CHART

FIELD OF THE INVENTION AND RELATED ART

The present invention relates to an image forming apparatus such as a copying machine, a printer, or a facsimile machine, of an electrophotographic type or an electrostatic recording type.

Conventionally, in the image forming apparatus of the electrophotographic type, a toner image is electrostatically transferred from an image bearing member onto a recording material such as paper. This transfer is carried out in many cases by applying a transfer voltage to a transfer member forming a transfer portion in contact with the image bearing member. In the image forming apparatus of an intermediary transfer type, the toner image formed on a first image bearing member such as a photosensitive drum is primary-transferred onto a second image bearing member such as an intermediary transfer belt and thereafter is secondary-transferred onto the recording material. In the following, description will be further made by using, as an example, secondary transfer in the image forming apparatus of the intermediary transfer type.

It is important for obtaining a high-quality image product that a secondary transfer voltage when the toner image on the intermediary transfer member is electrostatically transferred onto the recording material is made an appropriate value. In the case where the secondary transfer voltage is not sufficient for a charge amount possessed by toner on the intermediary transfer member, the toner image cannot be sufficiently transferred from the intermediary transfer member onto the recording material and a desired image density cannot be obtained in some instances. This image defect (poor density) is called "roughening" in some instances. Further, in the case where the secondary transfer voltage is excessively high, electric discharge occurs at a secondary transfer portion and a charge polarity of the toner on the intermediary transfer member is reversed by its electric discharge or the like, so that the toner image on the image bearing member cannot be partially transferred onto the recording material and a resultant image partially causes a white void in some instances. This image defect is called "while void" or "improper transfer" in some instances.

The secondary transfer voltage can be determined on the basis of (secondary) a transfer portion part voltage corresponding to the electrical resistance of the secondary transfer portion detected in a pre-rotation process before image formation or the like, and a recording material part voltage depending on a kind of recording material set in advance. By this, an appropriate secondary transfer voltage can be set according to environment fluctuations, transfer member usage history, the kind of the recording material, and the like.

However, there are various kinds and states of the recording material used in image formation, and therefore, depending on the recording material, a preset default recording material part voltage may be higher or lower than the appropriate secondary transfer voltage. Under the circumstances, it is proposed that an operation in an adjustment mode in which a set value of the secondary transfer voltage can be adjusted depending on the recording material actually used in the image formation is performed.

Japanese Laid-Open Patent Application No. 2013-37185 proposes an image forming apparatus operable in an adjustment mode for adjusting the set value of the secondary transfer voltage. In the operation in this adjustment mode, a chart (adjusting chart) on which a plurality of patches (test images) is formed and outputted on a single recording material while switching the secondary transfer voltage (test voltage) for each patch is formed. This chart is read by a reading portion provided in the image forming apparatus and a density of each patch is read. And, depending on a detection result thereof, an appropriate secondary transfer voltage condition is selected. Further, in the operation in the adjustment mode, the secondary transfer voltage for a second side in double-side printing is set on the basis of a density of a portion where a patch of a chart formed on the second side of the recording material does not overlap with a patch of a chart formed on a first side of the recording material.

However, it turned out that the following problem arises in the case where the secondary transfer voltage for the second side in the double-side printing is set on the basis of the second-side chart of a double-side chart formed on both sides (first side and second side) of the recording material.

That is, a density of the patch of the first-side chart changes depending on the secondary transfer voltage by the influence of application of the secondary transfer voltage switched every patch when the first-side chart is formed.

For that reason, when the second-side chart is formed, on the first side, the first-side patch of which density is not uniform exists. By this, when the density of the patch is detected by the reading portion, there is a possibility that it becomes difficult to accurately detect the density of the patch of the second-side chart by the influence of the density of the patch of the first-side chart.

Further, as described above, when the second-side chart is formed, on the first side, the first-side patch of which density is not uniform, i.e., of which toner adjustment mode is not uniform, exists. By this, there is a possibility that a variation occurs in a secondary transfer current necessary to secondary-transfer the patch of the second-side chart. That is, when each patch of the second-side chart is secondary-transferred, a toner part voltage by the patch of the first-side chart changes. As a result, during double-side printing, depending on an image density of an image on the first side, the influence of a toner layer (toner part voltage) on the first side during the secondary transfer of the image on the second side is different from the influence of the toner layer on the first side during the operation in the adjustment mode, or the like, whereby there is a possibility of an occurrence of an insufficient secondary transfer current, for example.

Due to these reasons, there is a possibility that the secondary transfer voltage for the second side in the double-side printing cannot be appropriately set.

SUMMARY OF THE INVENTION

Therefore, an object of the present invention is to provide an image forming apparatus capable of appropriately setting a secondary transfer voltage for a second side in double-side printing.

The above-described object is accomplished by the image forming apparatus according to the present invention. According to an aspect of the present invention, there is provided an image forming apparatus comprising: an image forming portion configured to form a toner image; a transfer portion configured to transfer, onto a recording material, the toner image formed by the image forming portion; a power source configured to apply a voltage to the transfer portion; a reading portion configured to read an image on the recording material; and a controller configured to execute an output operation for outputting a double-side chart including a first chart formed by transferring a plurality of first test images onto a first side of the recording material under application of a plurality of first test voltages from the power source to the transfer portion and a second chart formed by transferring a plurality of second test images onto a second side of the recording material under application of a plurality of second test voltages from the power source to the transfer portion and configured to execute an operation in a mode in which a transfer voltage for image transfer on the first side in double-side image formation is set on the basis of the plurality of first test images read by the reading portion and in which a transfer voltage for image transfer on the second side in the double-side image formation is set on the basis of the plurality of second test images read by the reading portion, wherein the controller executes the output operation so that the plurality of first test images do not overlap with the plurality of second test images, respectively, on the first side and the second side of the recording material, wherein on the basis of information on the first test voltage for transfer of the first test image, of the plurality of first test images, of which information on a density read by the reading portion coincides with a preset condition, the controller sets the transfer voltage for the image transfer on the first side in the double-side image formation, wherein on the basis of information on the second test voltage for transfer of the second test image, of the plurality of second test images, of which information on a density read by the reading portion coincides with the preset condition, the controller sets the transfer voltage for the image transfer onto the second side in the double-side image formation so that an absolute value of the transfer voltage set for the image transfer onto the second side in the double-side image formation is larger than an absolute value of the second test voltage coincided with the preset condition.

Further features of the present invention will become apparent from the following description of exemplary embodiments with reference to the attached drawings.

BRIEF DESCRIPTION OF THE DRAWINGS

FIG. 5 is a table showing an example of table data of recording material part voltage 3.

Figure 6:
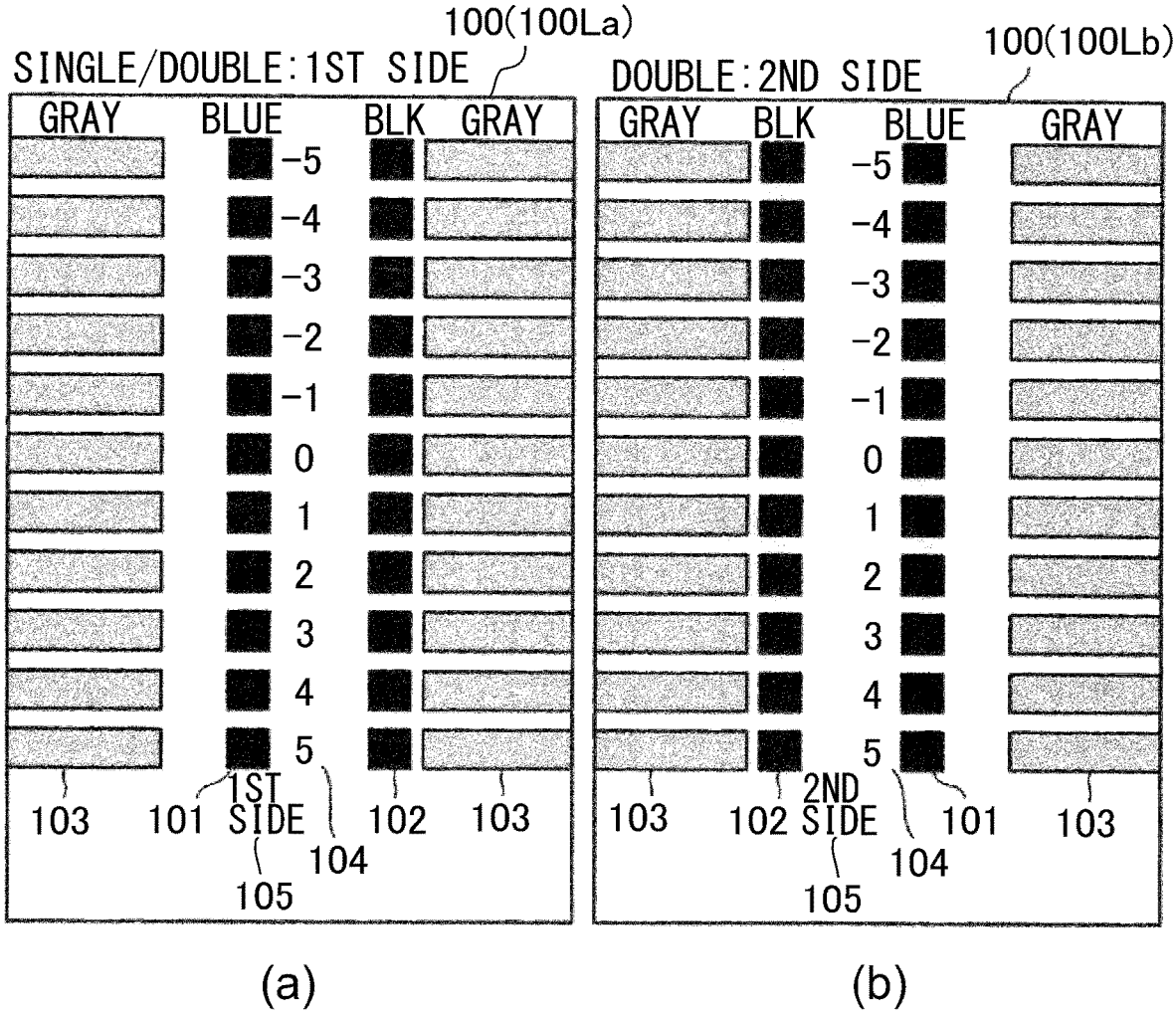

Parts (a) and (b) of FIG. 6 are schematic views of charts each outputted in an operation in an adjustment mode.

Figure 7:
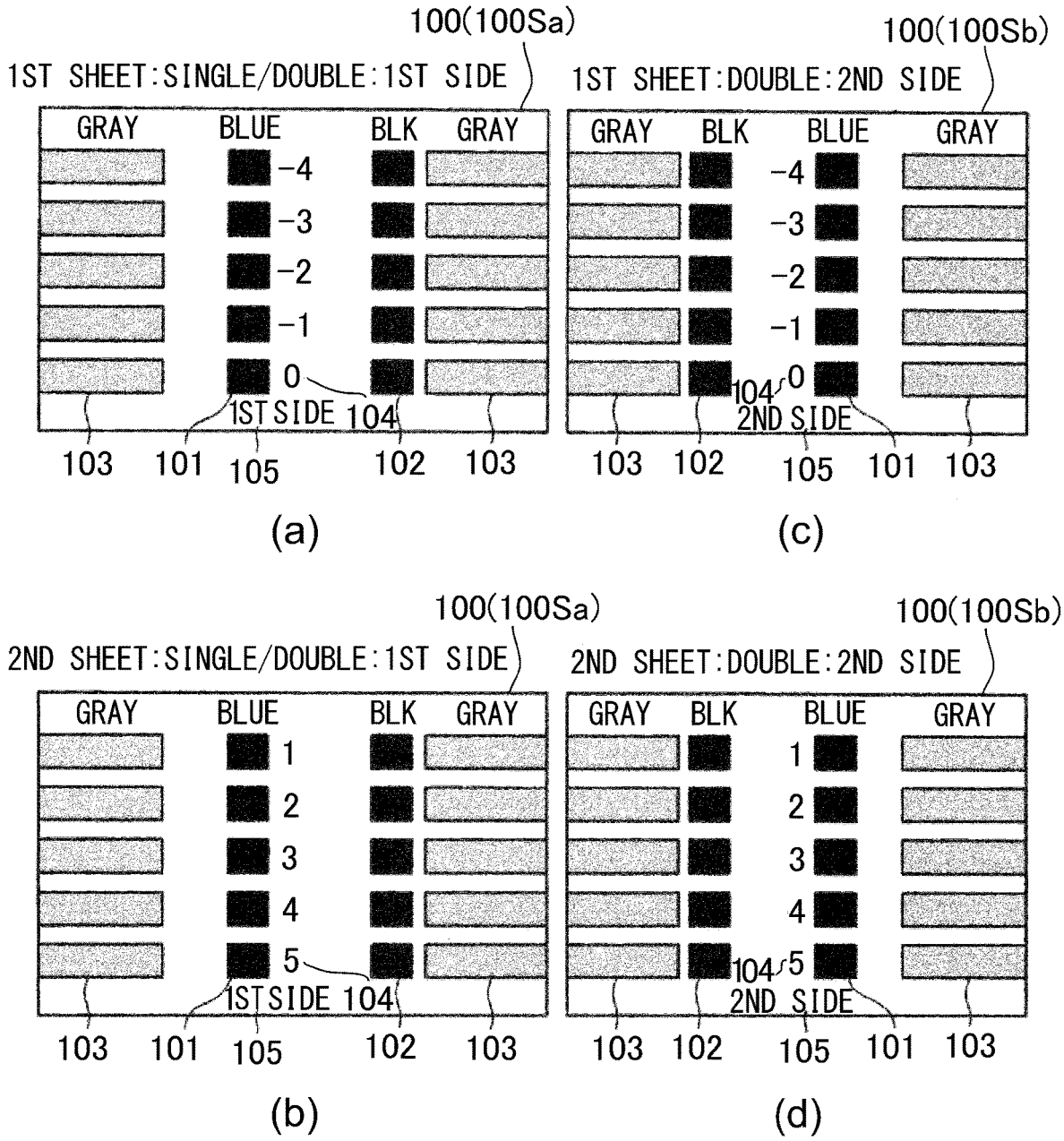

Parts (a) to (d) of FIG. 7 are schematic views of charts each outputted in an operation in an adjustment mode.

Figure 8:
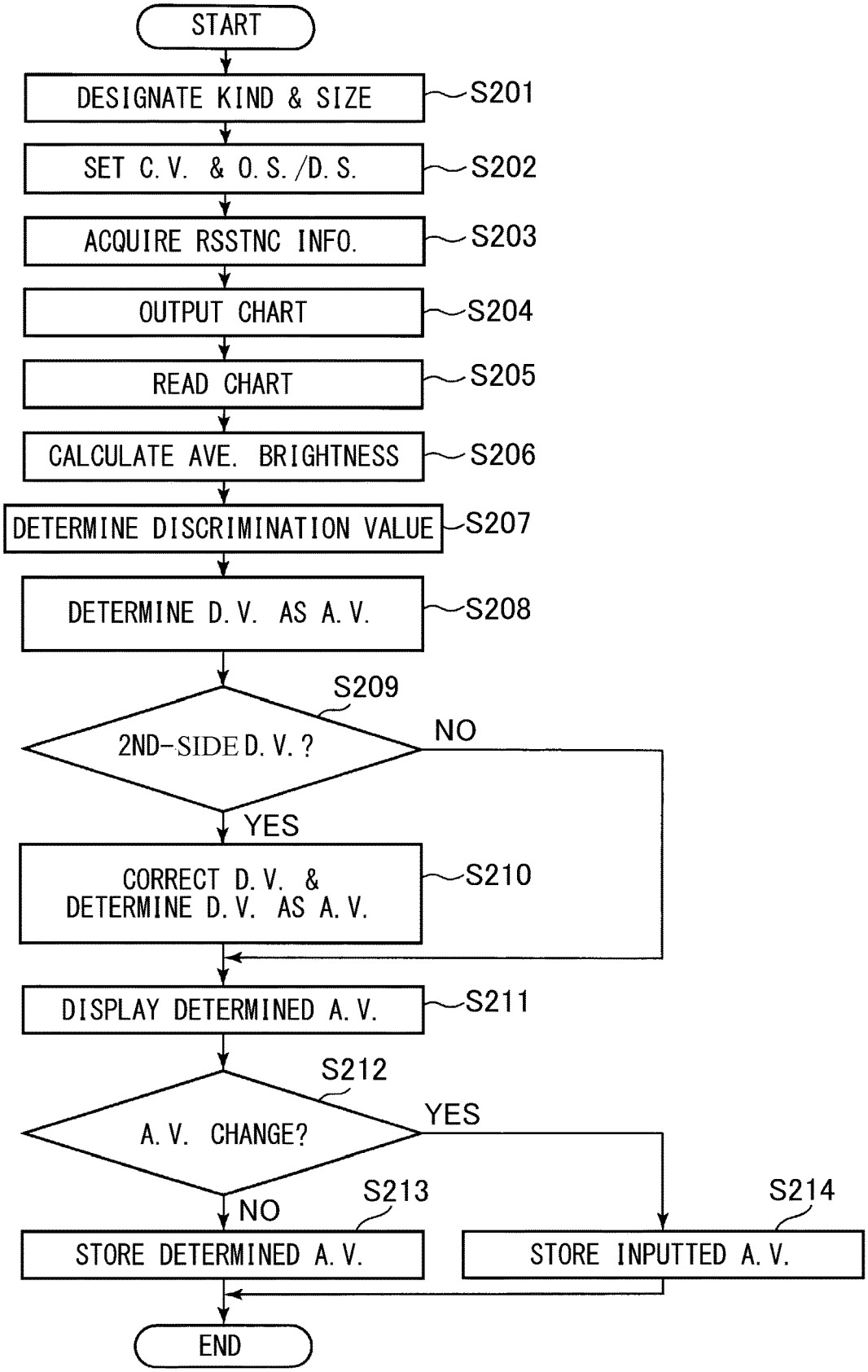

FIG. 8 is a flowchart showing an example of a procedure of the operation in the adjustment mode.

Figure 9:
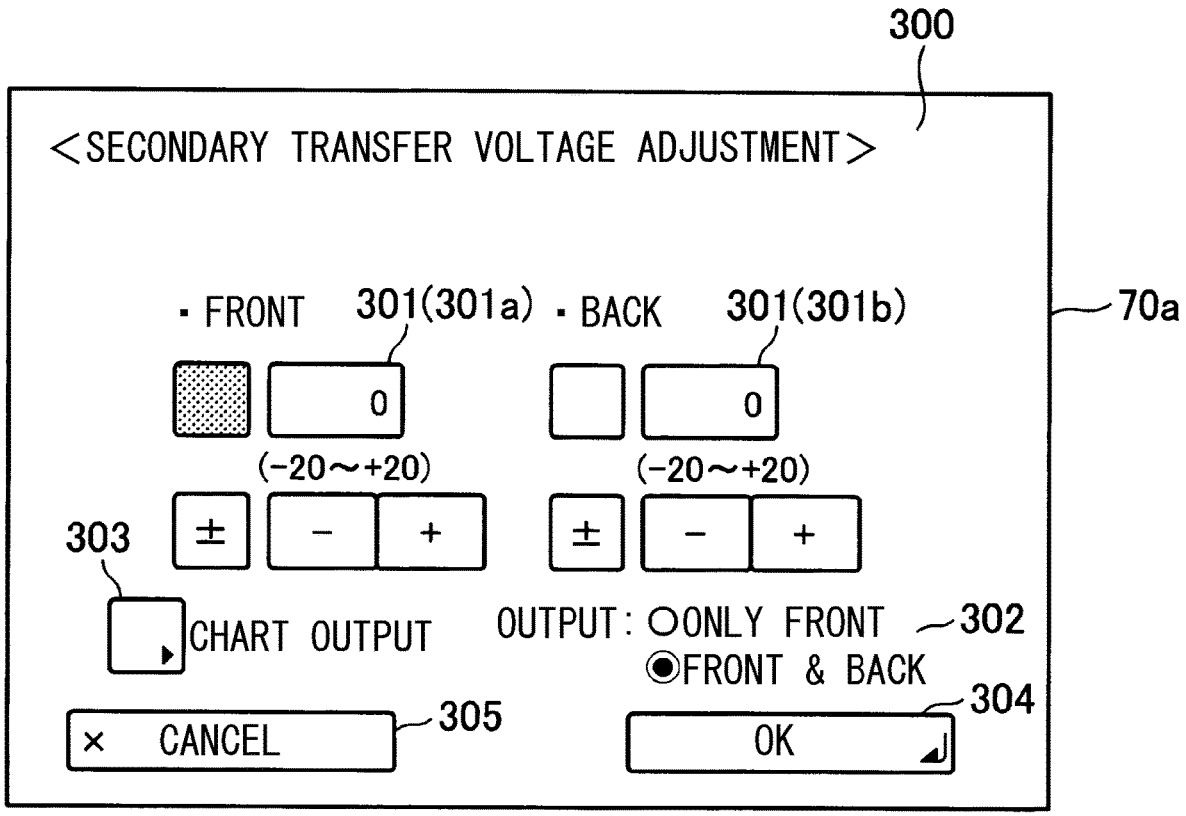

FIG. 9 is a schematic view showing an example of an adjusting screen of the secondary transfer voltage.

Figure 10:
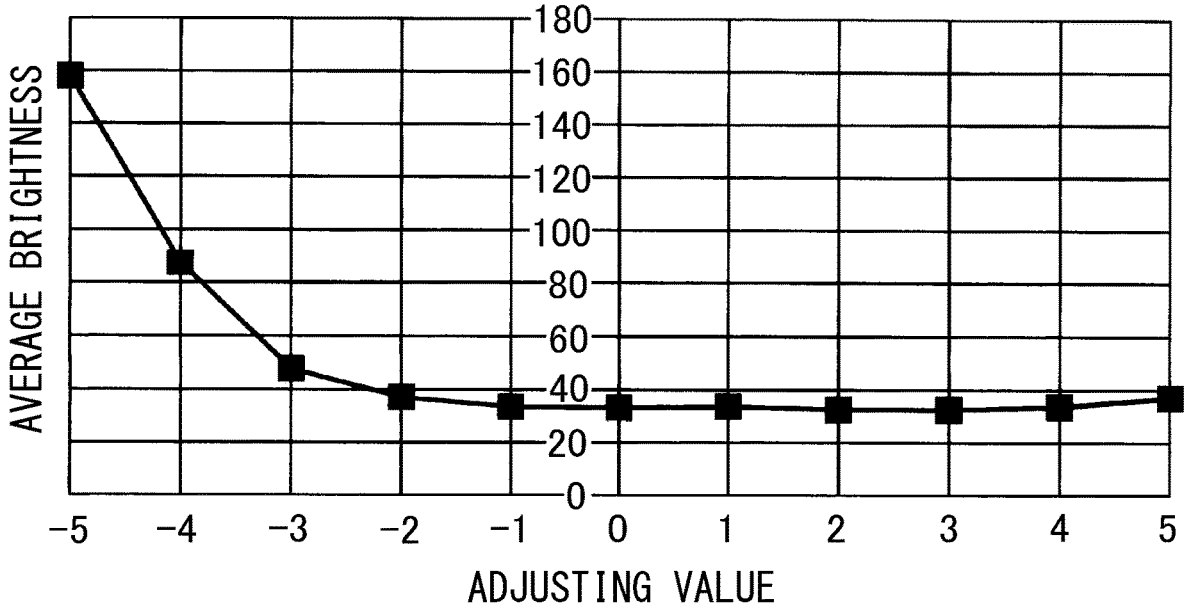

FIG. 10 is a graph showing an example of a relationship between an adjusting value of the secondary transfer voltage and an average brightness value.

Figure 11:
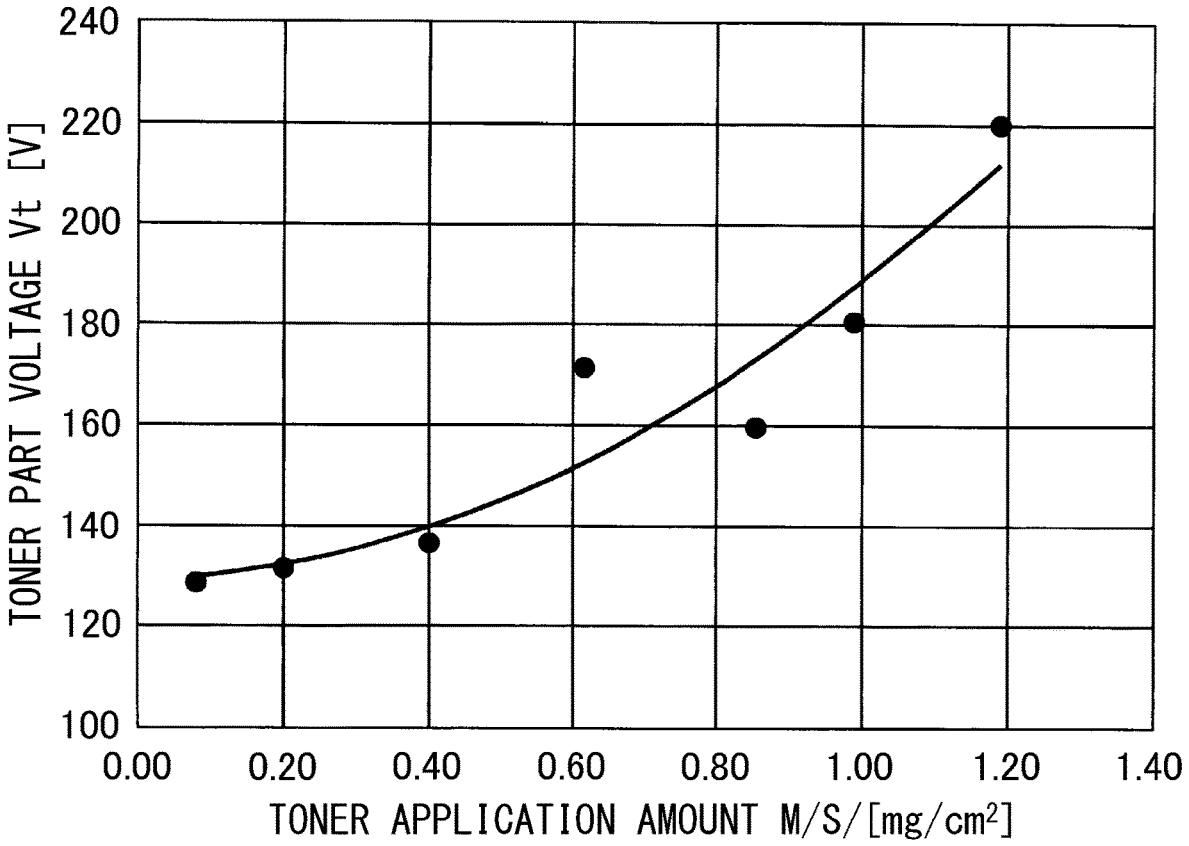

FIG. 11 is a graph showing an example of a relationship between a toner application amount and a toner part voltage.

Figure 12:
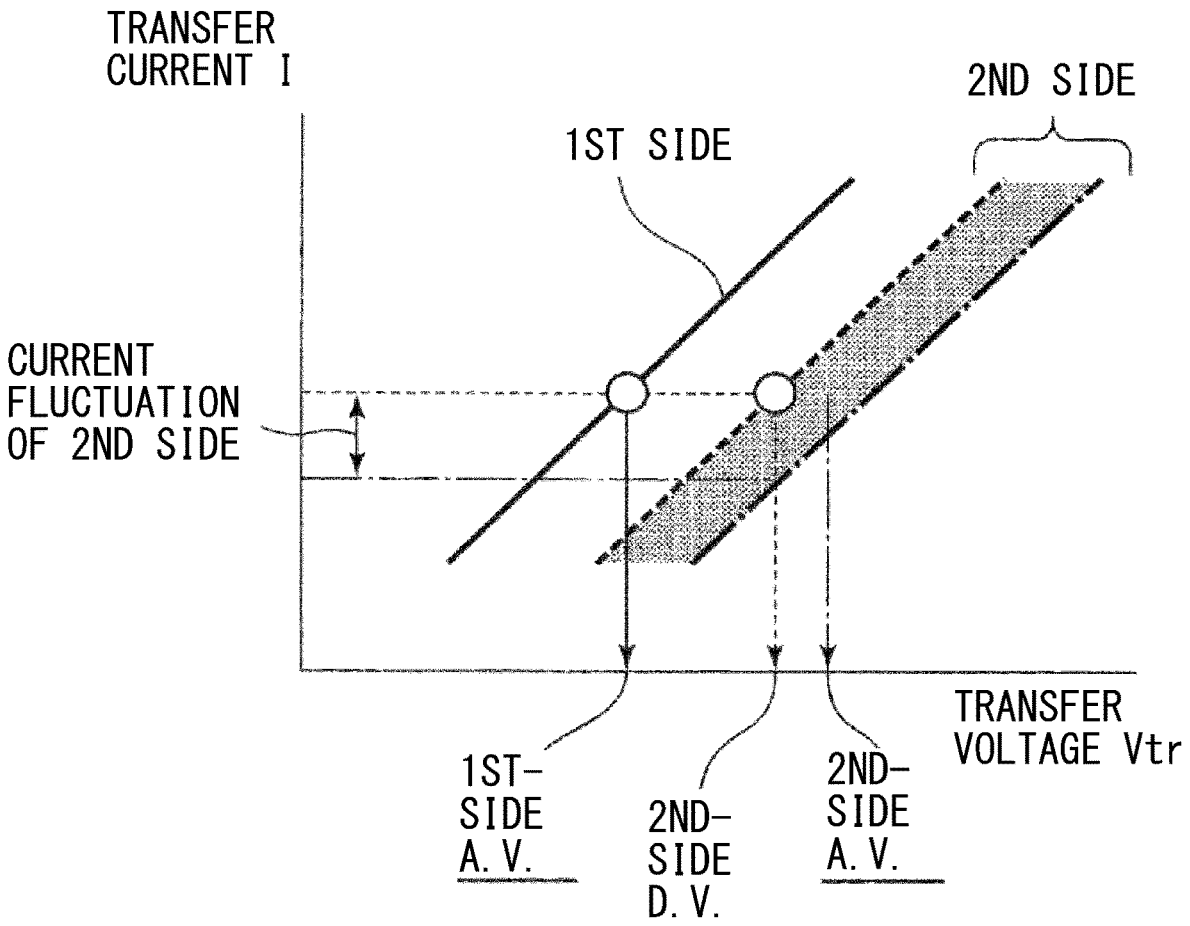

FIG. 12 is a schematic view for illustrating a determining method of the adjusting value of the secondary transfer voltage.

Figure 13:
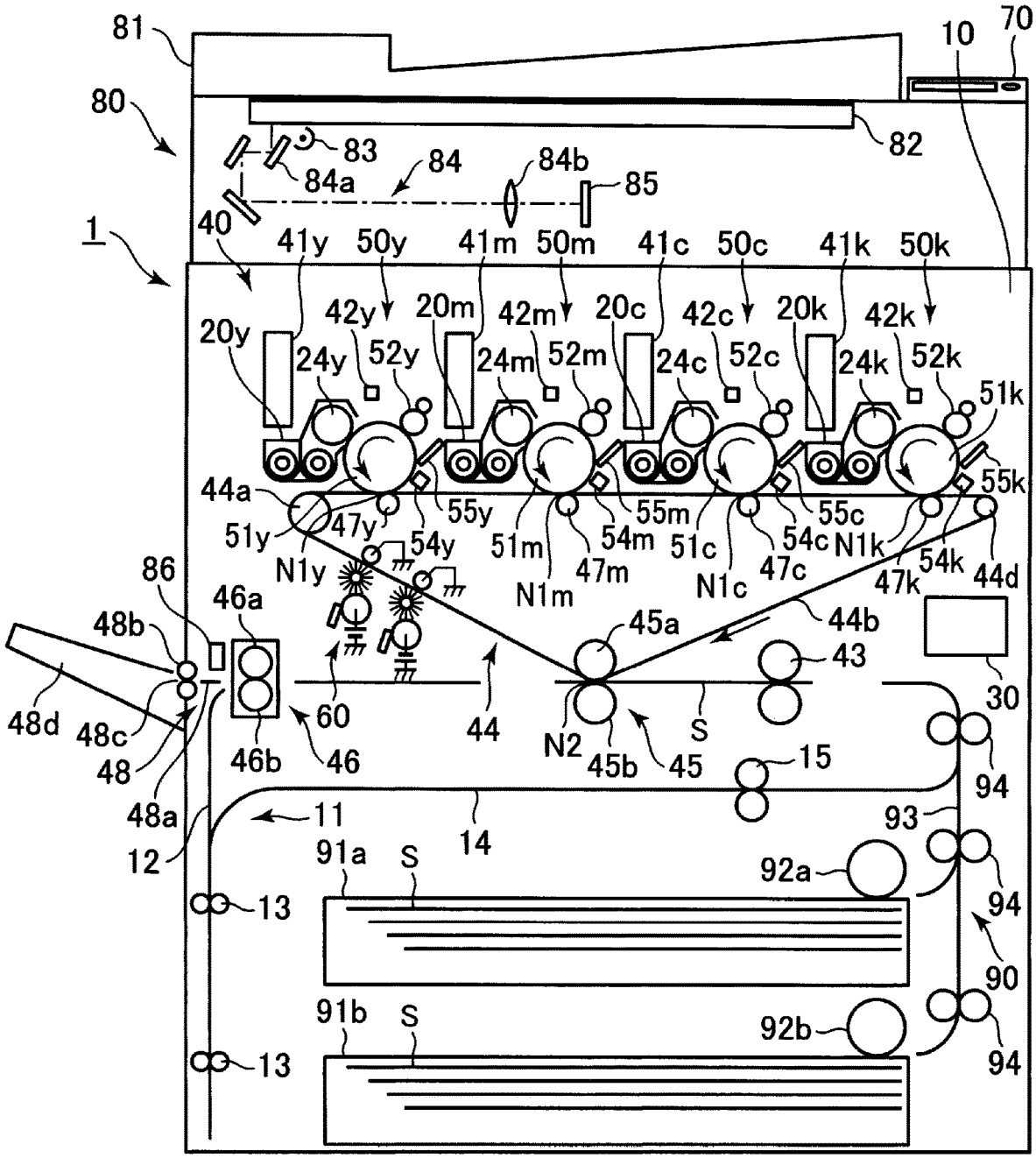

FIG. 13 is a schematic sectional view of an image forming apparatus in another embodiment.

Figure 14:
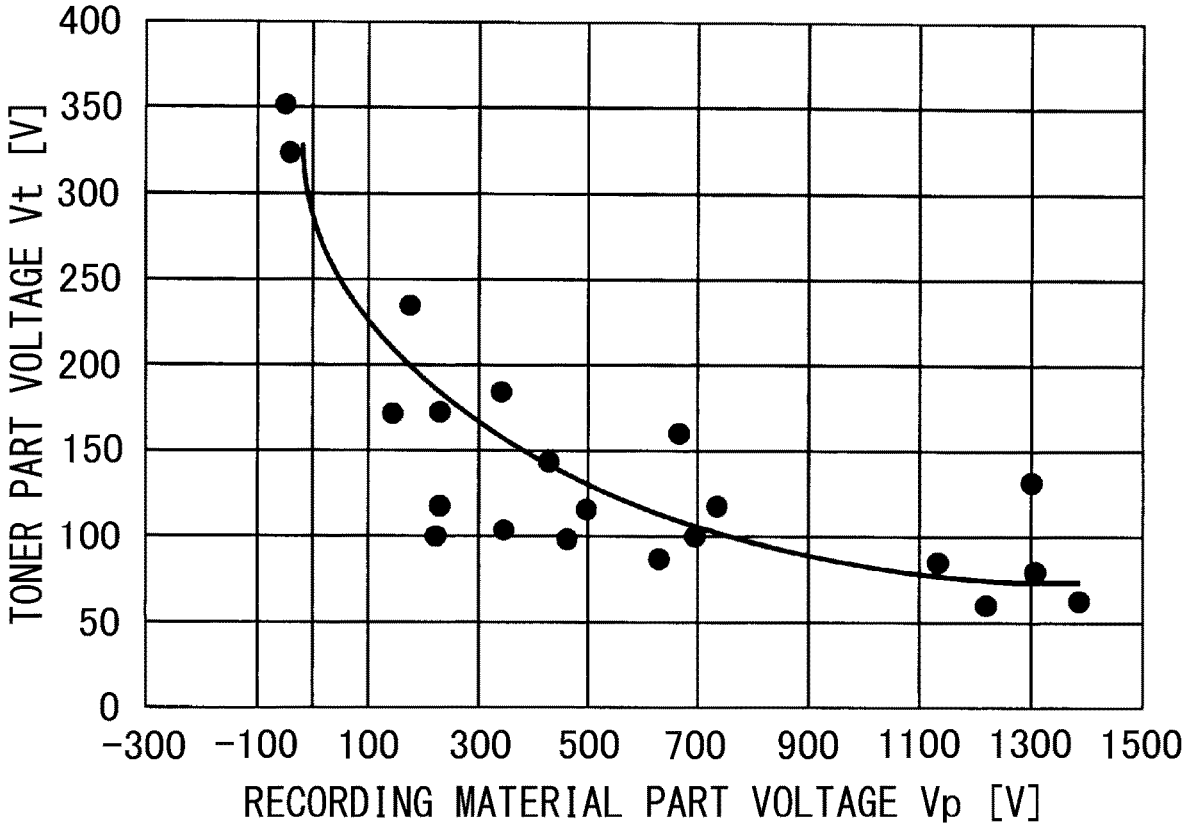

FIG. 14 is a graph showing an example of a relationship between a recording material part voltage and the toner part voltage.

Figure 15:
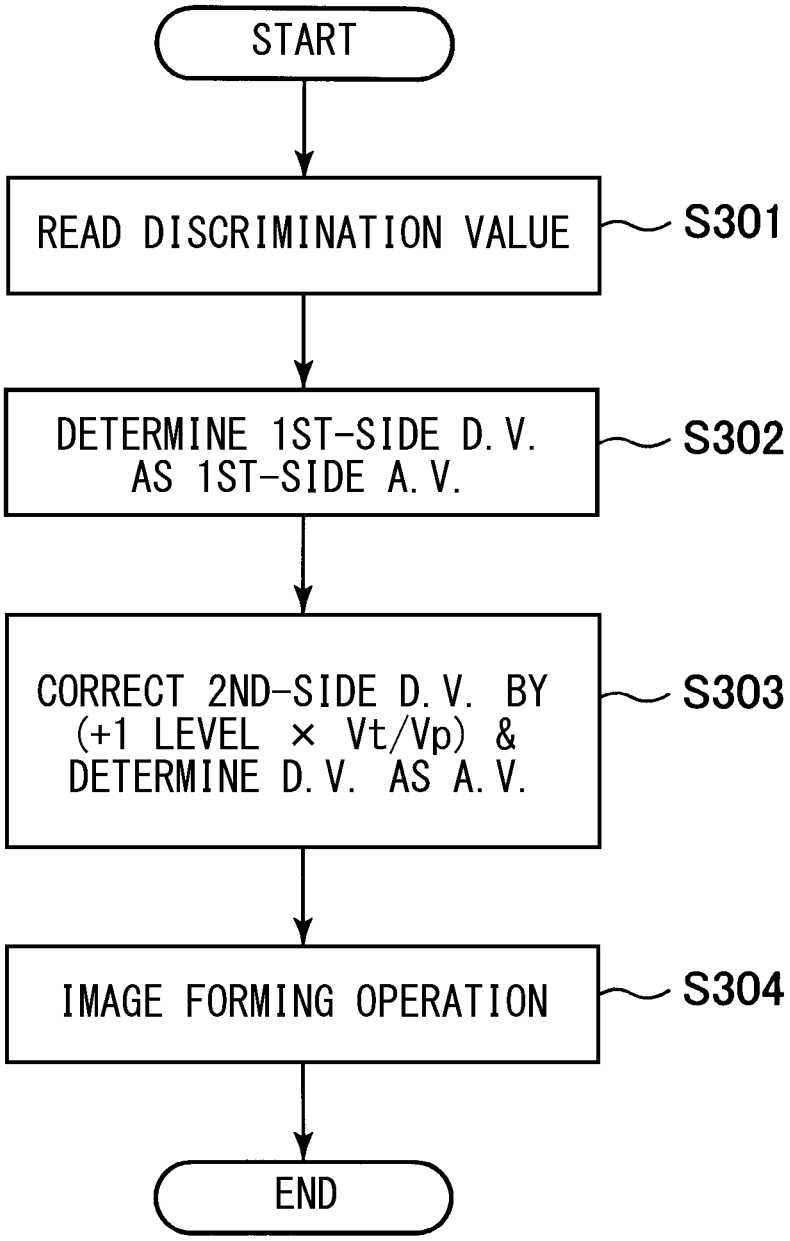

FIG. 15 is a flowchart showing an outline of a process for setting the secondary transfer voltage for double-side printing.

DESCRIPTION OF EMBODIMENTS

In the following, the image forming apparatus according to the present invention will be described in more detail with reference to the drawings.

Embodiment 1

1. Structure and Operation of Image Forming Apparatus

Figure 1:
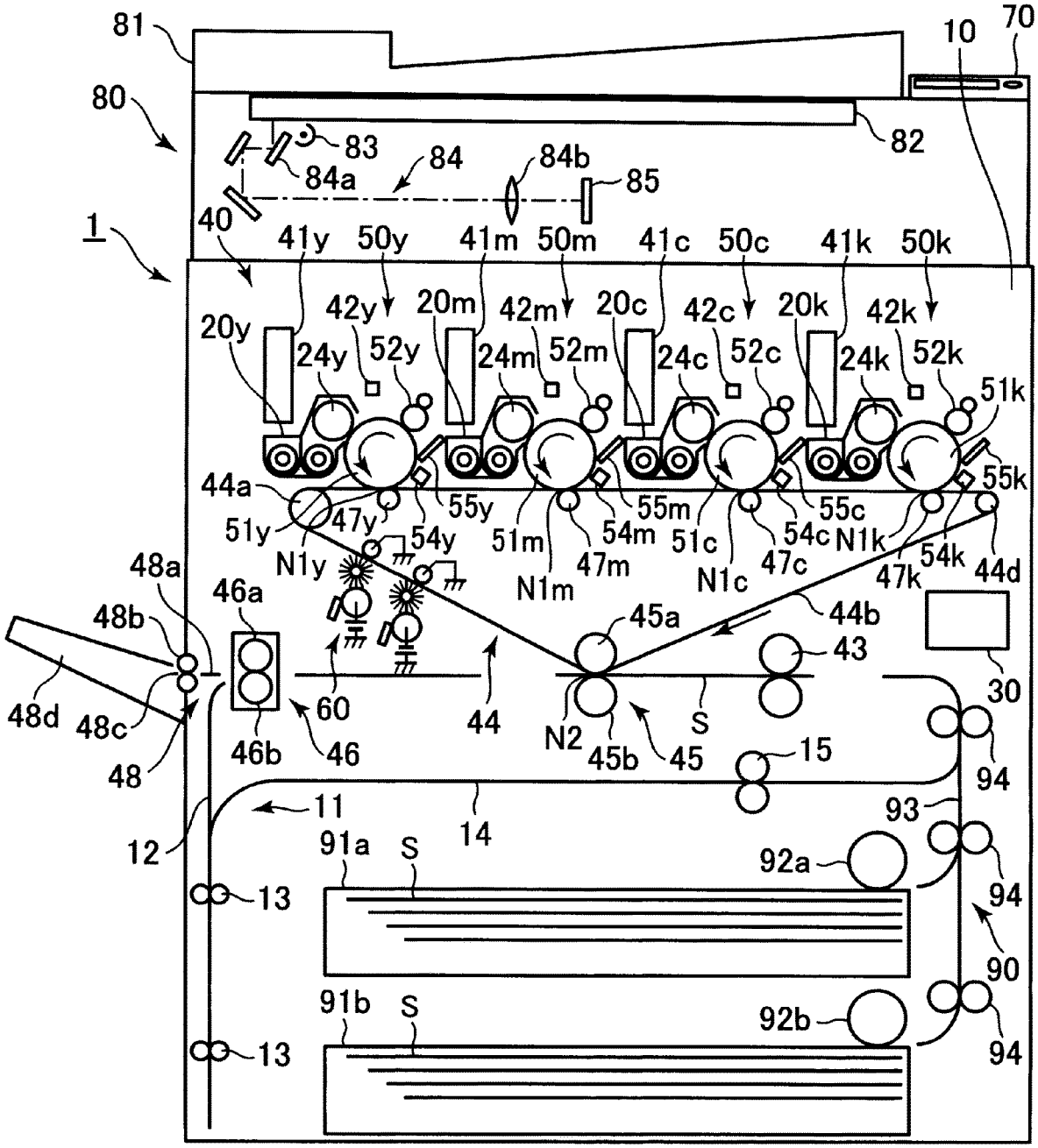
FIG. 1 is a schematic sectional view of an image forming apparatus.

FIG. 1 is a schematic cross-sectional view of an image forming apparatus 1 of this embodiment. The image forming apparatus 1 of this embodiment is a tandem type multi-function machine (having functions of a copying machine, a printer, and a facsimile machine) capable of forming a full-color image by using an electrophotographic type and employing an intermediary transfer type.

Figure 2:
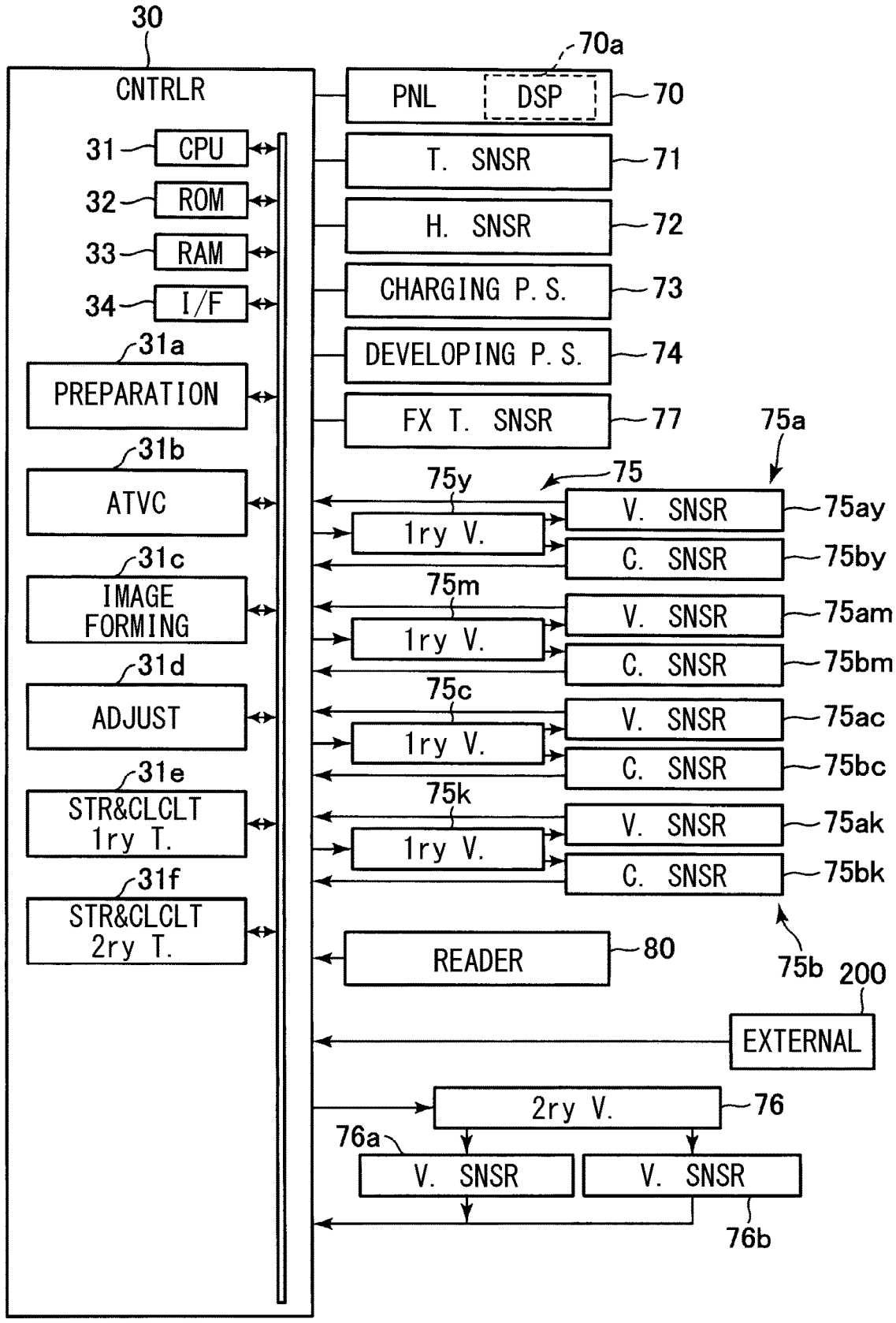
FIG. 2 is a block diagram showing a control system of the image forming apparatus.

As shown in FIG. 1, the image forming apparatus 1 includes an apparatus main assembly 10, a reading portion 80, a feeding portion 90, a printer portion 40, a discharging portion 48, a controller 30, an operation portion 70, and the like. Further, inside the apparatus main assembly 10, as an environment detecting means, a temperature sensor 71 (FIG. 2) capable of detecting a temperature inside the apparatus and a humidity sensor 72 (FIG. 2) capable of detecting a humidity inside the apparatus are provided. The environment detecting means may be one capable of detecting at least one of the temperature and the humidity on at least one of the inside and the outside of the image forming apparatus 1. The image forming apparatus 1 can form four-color-based full-color image on recording material (sheet, transfer material, recording medium, media) S, in accordance with image information (image signals) supplied from the reading portion 80 or an external device 200 (FIG. 2). As the external device 200, it is possible to cite, for example, a host device, such as a personal computer, or a digital camera or a smartphone. Incidentally, the recording material S is a material on which a toner image is formed, and specific examples thereof include plain paper, synthetic resin sheets which are substitutes for plain paper, thick paper, and overhead projector sheets.

The printer portion 40 can form the image on the recording material S fed from the feeding portion (feeding device 90) on the basis of the image information. The printer portion 40 includes four image forming units 50*y*, 50*m*, 50*c*, 50*k*, as a plurality of image forming portions, four toner bottles 41*y*, 41*m*, 41*c*, 41*k*, an intermediary transfer unit 44, a secondary transfer device 45, and a fixing portion 46. The image forming units 50*y*, 50*m*, 50*c* and 50*k* form yellow (Y), magenta (M), cyan (C), and black (K) images, respectively. Elements having the same or corresponding functions of structures provided for the respective colors will be collectively described by omitting suffixes y, m, c and k for representing elements for associated colors, respectively, in some instances. Incidentally, the image forming apparatus 1 can also form a single-color image such as a black image or a multi-color image by using the image forming unit 50 for a desired single color or some of the four image forming units 50.

The image forming unit 50 includes the following means. First, a photosensitive drum 51 which is a drum-type (cylindrical) photosensitive member (electrophotographic photosensitive member) as a first image bearing member is provided. In addition, a charging roller 52 which is a roller-type charging member is used as charging means. In addition, an exposure device 42 is provided as an exposure means. In addition, a developing device 20 is provided as developing means. In addition, a pre-exposure device 54 is provided as a charge eliminating means. In addition, a drum cleaning device 55 as a photosensitive member cleaning means is provided. The image forming unit 50 forms a toner image on the intermediary transfer belt 44*b* which will be described hereinafter. In the image forming unit 50, the photosensitive drum 51 and, as process means actable thereon, the charging roller 52, the developing device 20, and the drum cleaning device 55 are integrally assembled into a unit and constitute a process cartridge which can be mounted in and dismounted from the apparatus main assembly 10.

The photosensitive drum 51 is movable (rotatable) while carrying an electrostatic image (electrostatic latent image) or a toner image. In this embodiment, the photosensitive drum 51 is a negatively chargeable organic photosensitive member (OPC) having an outer diameter of 30 mm. The photosensitive drum 51 has an aluminum cylinder as a substrate and a surface layer formed on the surface of the substrate. In this embodiment, the surface layer includes three layers of an undercoat layer, a photocharge generation layer, and a charge transportation layer, which are applied and laminated on the substrate in the order named. Even an image forming operation is started, the photosensitive drum 51 is a driven to a rotate in a direction indicated by an arrow (counterclockwise) in the figure at a predetermined process speed (circumferential speed) by a motor (not shown) as a driving means.

The surface of the rotating photosensitive drum 51 is uniformly charged to a predetermined polarity (negative in this embodiment) and a predetermined potential by the charging roller 52. In this embodiment, the charging roller 52 is a rubber roller which contacts the surface of the photosensitive drum 51 and which is rotated by the rotation of the photosensitive drum 51. The charging roller 52 is connected with a charging voltage source 73 (FIG. 2). The charging bias power source 73 applies a predetermined charging voltage (charging bias) to the charging roller 52 during the charging process.

The surface of the charged photosensitive drum 51 is scanned and exposed by the exposure device 42 in accordance with the image information, so that an electrostatic image is formed on the photosensitive drum 51. The exposure device 42 is a laser scanner in this embodiment. The exposure device 42 emits laser beam in accordance with separated color image information outputted from the controller 30, and scans and exposes the surface (outer peripheral surface) of the photosensitive drum 51.

The electrostatic image formed on the photosensitive drum 51 is developed (visualized) by supplying the toner thereto by the developing device 20, so that a toner image is formed on the photosensitive drum 51. In this embodiment, the developing device 20 accommodates, as a developer, a two-component developer comprising non-magnetic toner particles (toner) and magnetic carrier particles (carrier). The toner is supplied from the toner bottle 41 to the developing device 20. The developing device 20 includes a developing sleeve 24. The developing sleeve 24 is made of a nonmagnetic material such as aluminum or nonmagnetic stainless steel (aluminum in this embodiment). Inside the developing sleeve 24, a magnet roller, which is a roller-shaped magnet, is fixed and arranged so as not to rotate relative to a main body (developing container) of the developing device 20. The developing sleeve 24 carries a developer and conveys it to a developing region facing the photosensitive drum 51. A developing voltage source 74 (FIG. 2) is connected to the developing sleeve 24. The developing voltage source 74 applies a predetermined developing voltage (developing bias) to the developing sleeve 24 during a developing step. In this embodiment, on an exposed portion (image portion) of the photosensitive drum 51 lowered in absolute value of the potential by being exposed after being uniformly charged, the toner charged to the same polarity (negative in this embodiment) as the charge polarity of the photosensitive drum 51 is deposited (reverse development). In this embodiment, the normal charge polarity of the toner, which is the charging polarity of the toner during development, is negative.

An intermediary transfer unit 44 is arranged so as to face the four photosensitive drums 51*y*, 51*m*, 51*c* and 51*k*. The intermediary transfer unit 44 includes an intermediary transfer belt 44*b*, which is an intermediary transfer member constituted by an endless belt, as a second image bearing member. The intermediary transfer belt 44*b* is wound around, as a plurality of stretching rollers (supporting rollers), a driving roller 44*a*, a driven roller 44*d*, and an inner secondary transfer roller 45*a*, and is stretched by a predetermined tension. The intermediary transfer belt 44*b* is movable (rotatable) while carrying the toner image. The driving roller 44*a* is rotationally driven by a motor (not shown) as driving means. The driven roller 44*d* is a tension roller which controls the tension of the intermediary transfer belt 44*b* to be constant. The driven roller 44*d* is subjected to a force which pushes the intermediary transfer belt 44*b* from an inner peripheral surface side toward an outer peripheral surface side by an urging force of a tension spring (not shown) which is an urging member as an urging means. By this force, a tension of about 2 to 5 kg is applied in the feeding direction of the intermediary transfer belt 44*b*. The inner secondary transfer roller 45*a* constitutes the secondary transfer device 45 as will be described hereinafter. The driving force is inputted to the intermediary transfer belt 44*b* by rotationally driving the driving roller 44*a*, and the intermediary transfer belt 44*b* is rotated (circulated) in the arrow direction (clockwise direction) in the figure at a predetermined peripheral speed corresponding to the peripheral speed of the photosensitive drum 51. In addition, on the inner peripheral surface side of the intermediary transfer belt 44*b*, the primary transfer rollers 47*y*, 47*m*, 47*c*, 47*k*, which are roller-type primary transfer members as primary transfer means, are disposed correspondingly to the photosensitive drums 51*y*, 51*m*, 51*c*, 51*k*, respectively. The primary transfer roller 47 holds the intermediary transfer belt 44*b* between itself and the photosensitive drum 51. By this, the primary transfer roller 47 contacts the photosensitive drum 51 by way of the intermediary transfer belt 44*b* to form a primary transfer portion (primary transfer nip) N1 where the photosensitive drum 51 and the intermediary transfer belt 44*b* are in contact with each other.

The toner image formed on the photosensitive drum 51 is primarily transferred onto the intermediary transfer belt 44*b* in the primary transfer portion N1. A primary transfer voltage source 75 (FIG. 2) is connected to the primary transfer roller 47. The primary transfer voltage supply 75 applies a primary transfer voltage (primary transfer bias) which is a DC voltage having a polarity opposite to the normal charging polarity of the toner (positive in this embodiment) to the primary transfer roller 47 during a primary transfer step. For example, when forming a full-color image, the yellow, magenta, cyan and black toner images formed on the photosensitive drums 51*y*, 51*m*, 51*c* and 51*k* are primarily transferred so as to be sequentially superimposed on the intermediary transfer belt 44*b*. The primary transfer voltage source 75 is connected to a voltage detecting sensor 75*a* which detects an output voltage and a current detecting sensor 75*b* which detects an output current (FIG. 2). In this embodiment, the primary transfer voltage sources 75*y*, 75*m*, 75*c* and 75*k* are provided for the primary transfer rollers 47*y*, 47*m*, 47*c* and 47*k*, respectively, and the primary transfer voltages applied to the primary transfer rollers 47*y*, 47*m*, 47*c* and 47*k* can be individually controlled.

Here, in this embodiment, the primary transfer roller 47 has an elastic layer of ion conductive foam rubber (NBR rubber) and a core metal. The outer diameter of the primary transfer roller 47 is, for example, 15 to 20 mm. In addition, as the primary transfer roller 47, a roller having an electric resistance value of $1\times10^5$ to $1\times10^8\Omega$ (N/N (23° C., 50% RH) condition, 2 kV applied) can be preferably used. Further, in this embodiment, the intermediary transfer belt 44*b* is an endless belt having a three-layer structure including a base layer, an elastic layer, and a surface layer in the order named from the inner peripheral surface side toward the outer peripheral surface side. As the resin material constituting the base layer, a resin such as polyimide or polycarbonate, or a material containing an appropriate amount of carbon black as an antistatic agent in various rubbers can be suitably used. The thickness of the base layer is, for example, 0.05 to 0.15 mm. As the elastic material constituting the elastic layer, a material containing an appropriate amount of an ionic conductive agent in various rubbers such as urethane rubber and silicone rubber can be suitably used. The thickness of the elastic layer is 0.1 to 0.500 mm, for example. As a material constituting the surface layer, a resin such as a fluororesin can be suitably used. The surface layer has small adhesive force of the toner to the surface of the intermediary transfer belt 44*b* and makes it easier to transfer the toner onto the recording material S at a secondary transfer portion N2 (described later). The thickness of the surface layer is, for example, 0.0002 to 0.020 mm. In this embodiment, for the surface layer, one kind of resin material such as polyurethane, polyester, epoxy resin, or two or more kinds of elastic materials such as elastic material rubber, elastomer, butyl rubber, for example, are used as a base material. And, as a material for reducing surface energy and improving lubricity of this base material, powder or particles such as fluororesin, for example, with one kind or two kinds or different particle diameters are dispersed, so that a surface layer is formed. In this embodiment, the intermediary transfer belt 44*b* has a volume resistivity of $5\times10^8$ to $1\times10^{14}$ Ω·cm (23° C., 50% RH) and a hardness of MD1 hardness of 60 to 85° (23° C., 50% RH). In this embodiment, static friction coefficient of the intermediary transfer belt 44*b* is 0.15 to 0.6 ((23° C., 50% RH), type 94i manufactured by HEIDON). Incidentally, in this embodiment, the three-layer structure was employed in the intermediary transfer belt 44*b*, but a single-layer structure of a material corresponding to the material of the above-described base layer may also be employed.

On the outer peripheral surface side of the intermediary transfer belt 44*b*, an outer secondary transfer roller 45*b* which constitutes the secondary transfer device 45 in cooperation with the inner secondary transfer roller 45*a* and which is a roller-type secondary transfer member as a secondary transfer means is disposed. The outer secondary transfer roller 45*b* sandwiches the intermediary transfer belt 44*b* between itself and the inner secondary transfer roller 45*a*. By this, the outer secondary transfer roller 45*b* contacts the inner secondary transfer roller 45*a* by way of the intermediary transfer belt 44*b* and forms a secondary transfer portion (secondary transfer nip) N2 where the intermediary transfer belt 44*b* and the outer secondary transfer roller 45*b* are in contact with each other. The toner image formed on the intermediary transfer belt 44*b* is secondarily transferred onto the recording material S, nipped and fed by the intermediary transfer belt 44*b* and the outer secondary transfer roller 45*b*, in the secondary transfer portion N2.

As described above, in this embodiment, the secondary transfer device 45 includes the inner secondary transfer roller 45*a* as a counter member, and the outer secondary transfer roller 45*b* as a secondary transfer member. The inner secondary transfer roller 45*a* is disposed opposed to the outer secondary transfer roller 45*b* by way of the intermediary transfer belt 44*b*. To the outer secondary transfer roller 45*b*, a secondary transfer voltage source 76 as a voltage applying means (applying portion) (FIG. 2) is connected. During a secondary transfer step, the secondary transfer voltage source 76 applies a secondary transfer voltage (secondary transfer bias) which is a DC voltage having a polarity opposite to the normal charge polarity of the toner (positive in this embodiment) to the outer secondary transfer roller 45*b*. To the secondary transfer voltage source 76, a voltage detecting sensor 76*a* for detecting the output voltage and a current detecting sensor 76*b* for detecting the output current are connected (FIG. 2). Further, in this embodiment, the core metal of the inner secondary transfer roller 45*a* is connected to the ground potential. That is, in this embodiment, the inner secondary transfer roller 45*a* is electrically grounded (connected to the ground). And, when the recording material S is supplied to the secondary transfer portion N2, a secondary transfer voltage with constant-voltage-control having a polarity opposite to the normal charge polarity of the toner is applied to the outer secondary transfer roller 45*b*. In this embodiment, a secondary transfer voltage of 1 to 7 kV is applied, a current of 40 to 120 μA, for example is caused to flow, and the toner image on the intermediary transfer belt 44*b* is secondarily transferred onto the recording material S. Incidentally, in this embodiment, the secondary transfer voltage source 76 applies the DC voltage to the outer secondary transfer roller 45*b*, so that the secondary transfer voltage is applied to the secondary transfer portion N2, but the present invention is not limited to such a constitution. For example, the secondary transfer voltage may also be applied to the secondary transfer portion N2 by applying the DC voltage from the secondary transfer voltage source 76 to the inner secondary transfer roller 45*a*. In this case, to the inner secondary transfer roller 45*a* as the secondary transfer member, the DC voltage of the same polarity as the normal charge polarity of the toner is applied, so that the outer secondary transfer roller 45*b* as the opposing member is electrically grounded. In this embodiment, the outer secondary transfer roller 45*b* includes an elastic layer of ion conductive foam rubber (NBR rubber) and a core metal. The outer diameter of the outer secondary transfer roller 45*b* is, for example, 20 to 25 mm. In addition, as the outer secondary transfer roller 45*b*, a roller having an electric resistance value of $1\times10^5$ to $1\times10^8\Omega$ (measured at N/N (23° C., 50% RH), 2 kV applied) can be preferably used.

The recording material S is fed from the feeding portion 90 in parallel to the above-described toner image forming operation. That is, the recording material S is stacked and accommodated in a recording material cassette 91 as a recording material accommodating portion. In this embodiment, the image forming apparatus 1 is provided with a plurality of recording material cassettes 91 (91*a*, 91*b*) each accommodating the recording materials S. The recording material S accommodated in each of the recording material cassettes 91 (91*a*, 91*b*) is fed toward a feeding passage 93 by a feeding roller 92 (92*a*, 92*b*) or the like as a feeding member. The recording material S fed to the feeding passage 93 is conveyed to a registration roller pair 43 as a feeding member by a conveying roller pair 94 as a conveying member. This recording q material S is subjected to correction of oblique movement by the registration roller pair 43, and is timed to the toner image on the intermediary transfer belt 44*b*, and then is supplied toward the secondary transfer portion N2. The feeding portion 90 is constituted by the recording material cassette 91, the feeding roller 92, the feeding passage 93, the conveying roller pair 94, and the like.

The recording material S onto which the toner image has been transferred is fed to a fixing portion (fixing device) 46 as a fixing means. The fixing portion 46 includes a fixing roller 46*a* and a pressing roller 46*b*. The fixing roller 46*a* includes therein a heater as a heating means. The recording material S carrying the unfixed toner image is heated and pressed by being sandwiched and fed between the fixing roller 46*a* and the pressing roller 46*b*. By this, the toner image is fixed (melted and fixed) on the recording material S. Incidentally, the temperature of the fixing roller 46*a* (fixing temperature) is detected by a fixing temperature sensor 77 (FIG. 2).

The recording material S on which the toner image is fixed is fed through a discharge passage 48*a* by a discharging roller pair 48*b* or the like as a feeding member, and is discharged (outputted) through a discharge opening 48*c*, and then is stacked on a discharge tray 48*d* provided outside the apparatus main assembly 10. A discharging portion (discharging device) 48 is constituted by the d is charge passage 48*a*, the discharging roller pair 48*b*, the discharge opening 48*c*, the discharge tray 48*d*, and the like. In the case of one-side printing (one-side image formation) in which the image is formed on one surface (side) on the recording material S is discharged as it is on the discharge tray 48*d* as described above. Further, in this embodiment, the image forming apparatus 1 is capable of forming images on double (both) sides (double-side printing, automatic double-side printing, double-side image formation) in which the images are formed on the double surfaces (sides) on the recording material S. In addition, between the fixing portion 46 and the discharge opening 48, a reverse feeding passage 12 for turning over the recording material S after the toner image is fixed on the first surface and for supplying the recording material S to the secondary transfer portion N2 again is provided. During the double-side printing, the recording material S after the toner image is fixed on the first surface is guided to the reverse feeding passage 12. This recording material S is reversed in feeding direction by a switch-back roller pair 13 device in the reverse feeding passage 12, and is guided to a double side feeding passage 14. Then, this recording material S is sent toward the feeding passage 93 by a re-feeding roller pair 15 provided in the double side feeding passage 14, and is conveyed to the registration roller pair 43, and then the recording material S is supplied toward the secondary transfer portion N2 by the registration roller pair 43. Thereafter, this recording material S is subjected to secondary transfer of the toner image on the second surface thereof similarly as during the image formation of the toner image on the first surface thereof, and after the toner image is fixed on the second surface, the recording material S is discharged to the discharge tray 48*d*. The double side feeding portion (double side feeding device) 11 is constituted by the reverse feeding passage 12, the switch-back roller pair 13, the double side feeding passage 14, therefeeding roller 15, and the like. By actuation of the double side feeding portion 11, it is possible to form the images on double surfaces (sides) of a single recording material S.

The surface of the photosensitive drum 51 after the primary transfer is electrically discharged by the pre-exposure device 54. In addition, a deposited matter such as toner remaining on the photosensitive drum 51 without being transferred onto the intermediary transfer belt 44*b* during the primary transfer step (primary transfer residual toner) is removed from the surface of the photosensitive drum 51 by the drum cleaning device 55 and is collected. The drum cleaning device 55 scrapes off the deposited matter from the surface of the rotating photosensitive drum 51 by a cleaning blade as a cleaning member contacting the surface of the photosensitive drum 51, and accommodates the deposited matter in a cleaning container. The cleaning blade is contacted at a predetermined pressing force to the surface of the photosensitive drum 51 so as to face a counter direction in which the outer end portion of the free end portion faces the upstream side in the rotational direction of the photosensitive drum 51. Further, the intermediary transfer unit 44 includes the belt cleaning device 60 as an intermediary transfer member cleaning means. A deposited matter such as toner remaining on the intermediary transfer belt 44*b* without being transferred onto the recording material S during the secondary transfer step (secondary transfer residual toner) or the like is removed and collected from the surface of the intermediary transfer belt 44*b* by the belt cleaning device 60.

At an upper portion of the apparatus main assembly 10, the reading portion 80 as a reading means is disposed. The reading portion 80 includes an automatic original feeding device (automatic document feeder (ADF) 81, a platen glass 82, a light source 83, an optical system 84 provided with a mirror group 84*a* and an imaging lens 84*b* and the like, and a reading element 85 such as a CCD. In this embodiment, the reading portion 80 is capable of sequentially reading an image of an original (the recording material on which the image is formed) by the reading element 85 by way of the optical system 84 while subjecting the image to scanning exposure to light by a movable optical source 82. In this case, the reading portion 80 sequentially illuminates the original disposed on the platen glass 82 with light by the moving optical source 83, and reflected light images from the original are sequentially formed on the reading element 85 by way of the optical system 84. By this, the original image can be read at a dot density determined in advance, by the reading element 85. Further, in this embodiment, the reading portion 80 sequentially exposes the original image fed by the automatic original feeding device 81 to light with feeding of the original, so that the reading portion 80 is capable of sequentially reading the original image by the reading element 85 by way of the optical system 84. In this case, the reading portion 80 sequentially illuminates the original passing through a predetermined reading position on the platen glass 82 with light by the light source 83, so that reflected light images from the original are sequentially formed on the reading element 85 by way of the optical system 84. By this, the original image can be read at the dot density determined in advance, by the reading element 85. The automatic original feeding device 81 automatically feeds the originals one by one in a separated state so as to pass through the above-described reading position of the reading portion 80. Thus, the reading portion 80 optically reads the image on the recording material S disposed on the platen glass 82 or fed by the automatic original feeding device 81 and then converts the image into an electric signal. In this embodiment, as regards the reading portion 80, on the platen glass 82, for example, a single recording material S of large size such as an A3 size can be disposed, or two recording materials S of a small size such as an A4 size can be juxtaposed. Further, in this embodiment, the reading portion 80 is capable of continuously feeding a plurality of recording materials S of the A3 size or the A4 size, stacked on an original stacking portion of the automatic original feeding device 81, to the above-described reading position. Further, the automatic original feeding device 81 is capable of automatically reading the images on both sides of the recording material S.

For example, in the case where the image forming apparatus 1 operates as a copying machine, the image of the original read by the reading portion 80 is sent, as image data for three colors of, for example, red (R), green (G), and black (B) (each 8 bits), to an image processing portion of the controller 30. In the image processing portion, the image data of the original is subjected to predetermined image processing as needed, and is converted into image data for four colors of yellow, magenta, cyan and black. As the above-described image processing, it is possible to cite shading correction, positional deviation correction, brightness/color space conversion, gamma correction, frame elimination, color/movement editing, and the like. The image data corresponding to the four colors of yellow, magenta, cyan and black are sequentially sent to the exposure devices 42*y*, 42*m*, 42*c* and 42*k*, respectively, and are subjected to the above-described image exposure depending thereon. Further, as described specifically later, the reading portion 80 is also used for reading patches of a chart (acquiring density information (brightness information) in an operation in an adjustment mode.

FIG. 2 is a block diagram showing a schematic constitution of a control system of the image forming apparatus 1 of this embodiment. As shown in FIG. 2, the controller 30 is constituted by a computer. The controller 30 includes, for example, a CPU 41 as a calculating means, a ROM 32 as a storing means for storing a program for controlling each portion, a RAM 33 as a storing means for temporarily storing data, and an input/output circuit (I/F) 34 for inputting/outputting signals to and from the outside. The CPU (calculating device) 31 is a microprocessor which controls the entire image forming apparatus 1 and is a main part of the system controller. The CPU 31 is connected to the feeding portion 90, the printer portion 40, the discharge portion 48, and the operation portion 70 via the input/output circuit 34, and exchanges signals with these portions, and controls the operation of each of these portions. The ROM 32 stores an image formation control sequence for forming the image on the recording material S. The controller 30 is connected to the charging voltage source 73, the developing voltage source 74, the primary transfer voltage source 75, and the secondary transfer voltage source 76, which are controlled by signals from the controller 30, respectively. In addition, the controller 30 is connected to the temperature sensor 71, the humidity sensor 72, the voltage detecting sensor 75*a* and the current detecting sensor 75*b* of the primary transfer voltage source 75, the voltage detecting sensor 76*a* and the current detecting sensor 76*b* of the secondary transfer voltage source 76, and the fixing temperature sensor 77. The signals detected by the respective sensors are inputted to the controller 30.

Then operating portion 70 includes an inputting portion such as an operation button as an input means, and a display portion 70*a* including a liquid crystal panel as display means. Incidentally, in this embodiment, the display unit 70*a* is constituted as a touch panel, and also has a function as the input means. An operator such as a user or a service person can cause the image forming apparatus 1 to execute a job (described later). The controller 30 receives the signal from the operating portion 70 and operates various devices of the image forming apparatus 1. The image forming apparatus 1 can also execute the job on the basis of an image forming signal (image data, control command) supplied from the external device 200 such as the personal computer.

In this embodiment, the controller 30 includes an image formation pre-preparation process portion 31*a*, an ATVC process portion 31*b*, an image formation process portion 31*c*, and an adjustment process portion 31*d*. In addition, the controller 30 includes a primary transfer voltage storage/operation portion 31*e* and a secondary transfer voltage storage/operation portion 31*f*. Here, each of these process portions and storage/operation portions may be provided as a portion or portions of the CPU 31 or the RAM 33. For example, the controller 30 (specifically the image formation process portion 31*c*) can execute a job. In addition, the controller 30 (specifically the ATVC process portion 31*b*) can execute ATVC (setting mode) for the primary transfer portion and the secondary transfer portion. Details of the ATVC will be described hereinafter. In addition, the controller 30 (specifically the adjustment process portion 31*d*) can execute an operation in an adjustment mode for adjusting a set value of the secondary transfer voltage. Details of the operation in the adjustment mode will be described hereinafter.

Incidentally, in this embodiment, the controller 30 (image forming process portion 31*c*) is capable of executing an operation in a plural-color mode in which a plurality of color images are formed by applying a primary transfer voltage to a plurality of primary transfer portions N1 and an operation in a single-color mode in which an image of a single color is formed by applying a primary transfer voltage to only one primary transfer portion N1 of the plurality of primary transfer portions N1.

Here, the image forming apparatus 1 executes the job (image output operation, print job) which is series of operations to form and output an image or images on single or a plurality of recording material S started by one start instruction. The job includes an image forming step, a pre-rotation step, a sheet (paper) interval step in the case where the images are formed on the plurality of recording material S, and a post-rotation step in general. The image forming step is performed in a period in which formation of an electrostatic image for the image actually formed and outputted on the recording material S, formation of the toner image, primary transfer of the toner image and secondary transfer of the toner image are carried out, in general, and during image formation (image forming period) refer to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction unit the image is started to be actually formed. The sheet interval step is performed in a period corresponding to an interval between a recording material S and a subsequent recording material S when the images are continuously formed on a plurality of recording materials S (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 1 or during restoration from a sleep state.

2. Control of Secondary Transfer Voltage

Figure 3:
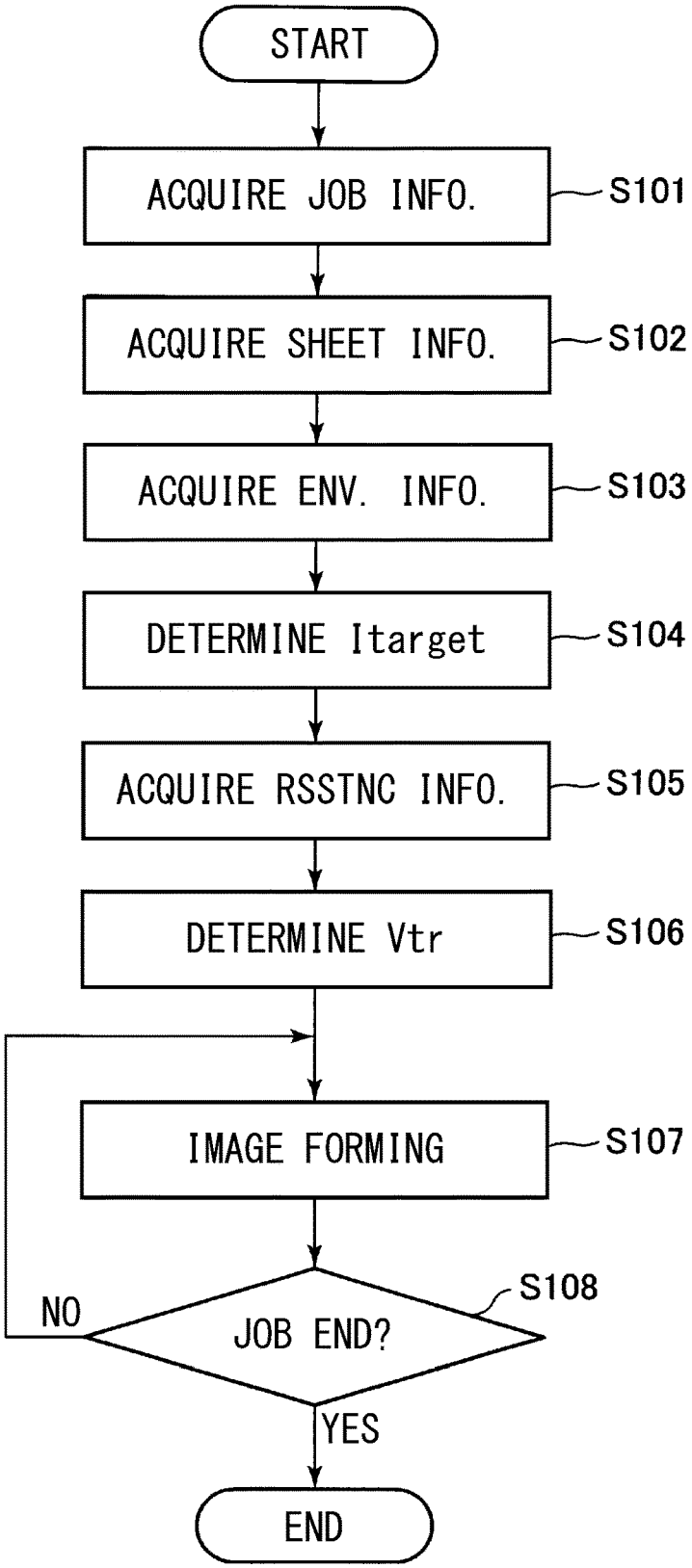
FIG. 3 is a flowchart showing an outline of a procedure of control of a secondary transfer voltage.

Next, control of the secondary transfer voltage will be described. FIG. 3 is a flow chart showing an outline of a procedure relating to the control of the secondary transfer voltage in this embodiment. Generally, the control of the secondary transfer voltage includes constant-voltage control and constant-current control, and in this embodiment, the constant-voltage control is used.

First, the controller 30 (image formation pre-preparation process portion 31*a*) causes the image forming portion to start an operation of a job when it acquires information on the job from the operation portion 70 or the external device 200 (S101). In the information on this job, image information designated by an operator and information on the recording material S are included. The information on the recording material S may include a size (width, length) of the recording material S on which the image is to be formed, information (thickness, basis weight and the like) relating to the thickness of the recording material S, and information relating to a surface property of the recording material S such as whether or not the recording material S is coated paper. Particularly, in this embodiment, the information on the recording material S includes information on the size of the recording material S and information on a category (so-called category of paper kind) of the recording material S such as "thin paper, plain paper, thick paper, . . . " relating to the thickness of the recording material S. Incidentally, the information relating to the recording material S (recording material information) includes any distinguishable pieces of information on the recording materials S, such as attributes (so-called the paper kind category) based on general characteristics including plain paper, high-quality paper, glossy paper (gloss paper), coated paper, embossed paper, thick paper, and thin paper; numerical value or numerical value ranges such as a basis weight, a thickness, a size, and rigidity; or brands (including manufacturers, trade names, model names, and the like). It can be understood that the kind of the recording material S is constituted for each of the recording materials S distinguished by the information relating to the recording material S. Further, the information relating to the recording material S may be included in information on a print mode for designating operation setting of the image forming apparatus 1, such as "plain paper mode" or "thick paper mode" or may also be substituted by the information relating to the print mode. The controller 30 (image formation pre-preparation process portion 31*a*) writes this job information in the RAM 33 (S102).

Next, the controller 30 (image formation pre-preparation process portion 31*a*) acquires environment information detected by the temperature sensor 71 and the humidity sensor 72 (S103). In the ROM 32, information showing correction between the environment information and a target current Itarget for transferring the toner image from the intermediary transfer belt 44*b* onto the recording material S is stored. The controller 30 (secondary transfer voltage storage/operation portion 31*f*) acquires the target current Itarget corresponding to the environment from the information showing the correlation between the environment information and the target current Itarget, on the basis of the environment information read in S103. Then, the controller 30 writes this target current Itarget in the RAM 33 (or the secondary transfer voltage storage/operation portion 31*f*) (S104). Incidentally, why the target current Itarget is changed depending on the environment information is that the toner charge amount varies depending on the environment. The information showing the correlation between the environment information and the target current Itarget has been acquired in advance by an experiment or the like.

Figure 4:
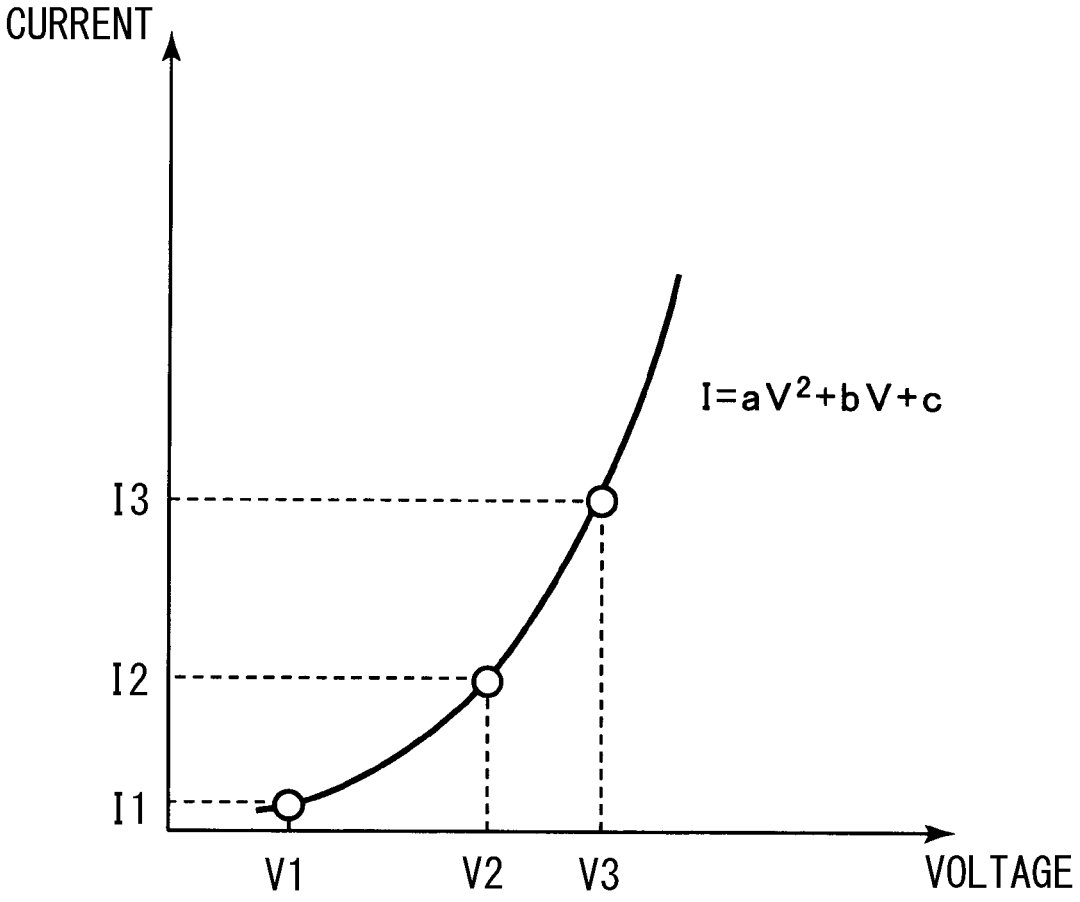
FIG. 4 is a graph showing a voltage-current characteristic acquired in the control of the secondary transfer voltage.

Next, the controller 30 (ATVC process portion 31*b*) acquires information on an electric resistance of the secondary transfer portion N2 by the ATVC (active transfer voltage control) before the toner image on the intermediary transfer belt 44*b* and the recording material S onto which the toner image is transferred reach the secondary transfer portion N2 (S105). That is, in a state in which the outer secondary transfer roller 45*b* and the intermediary transfer belt 44*b* are contacted to each other, predetermined voltages of a plurality of levels are applied (supplied) from the secondary transfer voltage source 76 to the outer secondary transfer roller 45*b*. Then, current values when the predetermined voltages are applied are detected by the current detecting sensor 76*b*, so that a relationship between the voltage and the current (voltage-current characteristic) as shown in FIG. 4 is acquired. The controller 30 writes information on this relationship between the voltage and the current in the RAM 33 (or the secondary transfer voltage storage/operation portion 31*f*). This relationship between the voltage and the current changes depending on the electric resistance of the secondary transfer portion N2. In the constitution of this embodiment, the relationship between the voltage and the current is not such that the current changes linearly relative to the voltage (i.e., is linearly proportional to the voltage), but is such that the current changes so as to be represented by a polynomial expression consisting of two or more terms of the voltage (quadratic expression in this embodiment). For that reason, in this embodiment, in order that the relationship between the voltages and the current can be represented by the polynomial expression, the number of predetermined voltages or currents supplied when the information on the electric resistance of the secondary transfer portion N is acquired is three or more (levels).

Then, the controller 30 (secondary transfer voltage storage/operation portion 31*f*) acquires a voltage value to be applied from the secondary transfer voltage source 76 to the outer secondary transfer roller 45*b* (S106). That is, on the basis of the target current Itarget written in the RAM 33 in S104 and the relationship between the voltage and the current acquired in S105, the controller 30 acquires a voltage vale Vb necessary to cause the target current Itarget to flow in a state in which the recording material S is absent in the secondary transfer portion N2. This voltage value Vb corresponds to a secondary transfer portion part voltage (transfer voltage corresponding to the electric resistance of the secondary transfer portion N2). Incidentally, a constitution in which the target current Itarget is applied from the secondary transfer voltage source 76 to the outer secondary transfer roller 45*b* by constant-current control and a voltage value at that time is detected by the voltage detecting sensor 76*a* and in which a detected voltage is set at a voltage value Vb can also be employed. Further, in the ROM 32, information for acquiring a recording material part voltage (transfer voltage corresponding to the electric resistance of the recording material S) Vp as shown in FIG. 5 is stored. In this embodiment, this information is set as table data indicating a relationship between water content and the recording material part voltage Vp in an ambient atmosphere for each of sections (corresponding to paper kind categories) of basis weights of recording material S. Incidentally, the controller 30 (image formation pre-preparation process portion 31) is capable of acquiring ambient water content on the basis of environment information (temperature, humidity) detected by the temperature sensor 71 and the humidity sensor 72. On the basis of the information on the job acquired in S101 and the environment information acquired in S103, the controller 30 (secondary transfer voltage storage/operation portion 31*f*) acquires the recording material part voltage Vp from the above-described table data. Further, in the case where the adjusting value is set by the operation in the adjustment mode, described later, for adjusting the set value of the secondary transfer voltage, the controller 30 (secondary transfer voltage storage/operation portion 31*f*) acquires an adjusting amount ΔV depending on the adjusting value. As described later, this adjusting amount ΔV is stored in the RAM 33 (or the secondary transfer voltage storage/operation portion 31*f*) in the case where the adjusting value is set by the operation in the adjustment mode. The controller 30 acquires Vb+Vp+ΔV which is the sum of the above-described voltage values Vb, Vp and ΔV, as a secondary transfer voltage Vtr applied from the secondary transfer voltage source 76 to the outer secondary transfer roller 45*b* when the recording material S passes through the secondary transfer portion N2. Then, the controller 30 writes this Vtr (=Vb+Vp+ΔV) in the RAM 33 (or the secondary transfer voltage storage/operation portion 31*f*). Incidentally, the table data for acquiring the recording material part voltage Vp as shown in FIG. 5 are acquired in advance by the experiment or the like.

Here, the recording material part voltage Vp also changes depending on a surface property of the recording material S other than the information (thickness, basis weight or the like) relating to the thickness of the recording material S in some instances. For that reason, the table data may also be set so that the recording material part voltage Vp changes also depending on the information relating to the surface property of the recording material S. Further, in this embodiment, the information relating to the thickness of the recording material S (and in addition, the information relating to the surface property of the recording material S) are included in the job information acquired in S101. However, a measuring means for detecting the thickness of the recording material S and the surface property of the recording material S is provided in the image forming apparatus 1, and the recording material part voltage Vp may also be acquired on the basis of information acquired by this measuring means.

Next, the controller 30 (the image formation process portion 31*c*) causes the image forming portion to form the image and to send the recording material S to the secondary transfer portion N2 and causes the secondary transfer device to perform the secondary transfer by applying the secondary transfer voltage Vtr determined as described above (S107). Thereafter, the controller 30 (the image formation process portion 31*c*) repeats the processing of S107 until all the images in the job are transferred and completely outputted on the recording material S (S108).

Incidentally, also as regards the primary transfer portion N1, the ATVC similar to the above-described ATVC is carried out in a period from a start of the job until the toner image is fed to the primary transfer portion N1, but detailed description thereof will be omitted in this embodiment.

3. Outline of Adjustment Mode

Next, an operation in an adjustment mode (simple adjustment mode) for adjusting the set value of the secondary transfer voltage will be described.

Depending on the kind (type) and condition of the recording material S used in image formation, the water (moisture) content and electrical resistance value of the recording material S differ greatly from those of the standard recording material S in some instances. In this case, optimal transfer cannot be performed in some instances at the set value of the secondary transfer voltage using a default recording material part voltage Vp set in advance as described above. That is, first, the secondary transfer voltage needs to be a voltage necessary for transferring the toner from the intermediary transfer belt 44*b* to the recording material S. In addition, the secondary transfer voltage must be suppressed to a voltage at which the abnormal discharge does not occur. However, depending on the kind and state of the recording material S actually used for image formation, the electrical resistance is higher than the value assumed as a standard value in some instances. In such a case, the voltage required to transfer the toner from the intermediary transfer belt 44*b* to the recording material S is insufficient at the set value of the secondary transfer voltage using the preset default recording material part voltage Vp in some instances. Therefore, in this case, it is desired to increase the secondary transfer voltage by increasing the recording material part voltage Vp or the like. On the contrary, depending on the kind and condition of the recording material S actually used for image formation, the recording material S absorbs moisture or the like, with the result that the electrical resistance is lower than the value assumed as a standard value, and the electrical discharge is liable to occur in some instances. In this case, at the set value of the secondary transfer voltage using the preset default recording material part voltage Vp, image defects due to the abnormal discharge occur in some instances. Therefore, in this case, it is desirable to lower the secondary transfer voltage by reducing the recording material part voltage Vp or the like.

Therefore, it is desired in some instances that the operator such as a user or a service person adjusts (changes) the recording material part voltage Vp depending on the recording material S actually used for image formation and thus adjusts (changes) the set value of the secondary transfer voltage during the execution of the job to an appropriate value. That is, it is desired in some instances that an appropriate recording material part voltage Vp+Vb (adjustment amount) depending on the recording material S actually used for image formation is selected. It would be considered that this adjustment is performed by the following method. That is, for example, the operator outputs the images intended to be outputted while switching the secondary transfer voltage for each recording material S, and confirms the output image and determines the set value of the secondary transfer voltage (specifically the recording material part voltage Vp+ΔV). However, in this method, since the outputting operation of the image and the adjustment of the set value of the secondary transfer voltage are repeated, the recording material S which is wasted increases, and it takes time to adjust the set value in some instances.

Therefore, in this embodiment, the image forming apparatus 1 is made operable in the adjustment mode in which the set value of the secondary transfer voltage is adjusted. In this operation in the adjustment mode, a chat on which a plurality of representative color patches (test image) are transferred while the set value of the secondary transfer voltage (test voltage) is switched for each patch is formed and outputted. And, the appropriate set value of the secondary transfer voltage (more specifically, the recording material part voltage Vp+ΔV) can be determined on the basis of the outputted chart. In this embodiment, in the operation in the adjustment mode, on the basis of a result, read by the reading portion 80, of density information (brightness information) of a patch (typically, solid image patch) on the chart, the controller 30 presents information relating to a recommended adjusting amount ΔV of the set value of the secondary transfer voltage. By this, necessity that the operator confirms the image on the chart by eye observation or the like is reduced, so that it becomes possible to more appropriately adjust the set value of the secondary transfer voltage while alleviating an operation load of the operator.

4. Chart

Next, the chart (image for adjustment, test page) outputted in the operation in the adjustment mode in this embodiment will be described. Parts (a) and (b) of FIG. 6 and parts (a) to (d) of FIG. 7 are schematic illustrations each showing a chart 100 in this embodiment.

In this embodiment, in the operation in the adjustment mode, depending on a size of the recording material S used, roughly, two kinds of charts 100 shown in FIG. 6 and FIG. 7, respectively, are outputted. Each of parts (a) and (b) of FIG. 6 shows the chart 100 outputted in the case where a length of the recording material S with respect to a recording material feeding direction is 420 mm-487 mm. Each of parts (a) to (d) of FIG. 7 shows the chart 100 outputted in the case where the length of the recording material S with respect to the recording material feeding direction is 210 mm-419 mm. Incidentally, in this embodiment, the chart can be formed and outputted on double surfaces (sides) of the recording material S so that the secondary transfer voltage during the secondary transfer onto each of a first side (front side) and a second side (back side) in double-side printing can be adjusted. In each of FIG. 6 and FIG. 7, the chart in the case where the chart is formed on one side of the recording material S (hereinafter, this chart is referred to as a "one-side chart") and the chart in the case where the chart is formed on double sides of the recording material S (hereinafter, this chart is referred to as a "double-side chart") are shown. In this embodiment, formation of the chart 100 is performed by an operation in a full-color mode. The double side chart is formed by the double-side printing operation using the above-described double side feeding portion 11.

Here, the size of the recording material S is represented by (recording material width (length with respect to a main scan direction))×(recording material length with respect to a sub-scan direction)). The recording material width is a length of the recording material S with respect to a direction (widthwise direction) substantially perpendicular to the recording material feeding direction when the recording material S passes through the secondary transfer portion N2. The recording material length is a length of the recording material S with respect to a direction substantially parallel to the recording material feeding direction when the recording material S passes through the secondary transfer portion N2.

Each of parts (a) and (b) of FIG. 6 shows a chart for a large size (hereinafter, referred to as a "large chart") 100L (100La, 100Lb) outputted in the case where a recording material S of a large size such as A3 size (297 mm×420 mm) or ledger size (about 280 mm×about 432 mm) is used. Part (a) shows a large chart 100La in the case where the one side chart is outputted (or on the first surface in the case where the double side chart is outputted). Further, part (b) of FIG. 6 shows a large chart 100Lb on the second surface in the case where the double side is outputted.

Each of parts (a) to (d) of FIG. 7 shows a chart for a small size (hereinafter, referred to as a "small chart") 100S (100Sa, 100Sb) outputted in the case where a recording material S of a small size such as A4 landscape size (297 mm×210 mm) or letter landscape size (about 280 mm×about 216 mm) is used. Parts (a) and (b) of FIG. 7 show a small chart 100Sa on a first sheet and a small chart 100Sa on a second sheet, respectively, in the case where the one side chart is outputted (or on the first surface in the case where the double side chart is outputted). Parts (c) and (d) of FIG. 7 show a small chart 100Sa on a first sheet and a small chart 100Sb on a second sheet, respectively, on the second surface in the case where the double side chart is outputted.

In this embodiment, the chart 100 includes a patch set in which one blue solid patch 101, one black solid patch 102, and two halftone patches 103 are arranged in the widthwise direction. And, in the large chart 100L of FIG. 6, eleven sets of patch sets 101 to 103 in the widthwise direction are arranged in the feeding direction. Further, in the small chart 100S of FIG. 7, ten sets of the patch sets 101 to 103 in the widthwise direction are arranged in the feeding direction. Incidentally, in this embodiment, the halftone patches 103 are gray (black halftone) patches. Here, the solid image is an image with a maximum density level. In this embodiment, the blue solid image is a superposed image of images of magenta (M) toner=100% and cyan (C) toner=100% and is 200% in toner application amount. The black solid image is an image of black (K) toner=100%. Further, the halftone image is, for example, an image with a toner application amount of 10-80% when the toner application amount of the solid image is 100%. In addition, in this embodiment, the chart 100 includes patch identification information 104 for identifying the set value of the secondary transfer voltage applied to each patch set in association with each of 11 patch sets 101 to 103. This identification information 104 may be a value corresponding to an adjusting (adjustment) value of the secondary transfer voltage (described later). In the large chart 100L of FIG. 6, eleven pieces of the patch identification information 104 (11 pieces of −5 to 0 to +5 in this embodiment) corresponding to eleven steps (levels) of secondary transfer voltage settings are provided. In the small chart 100S of FIG. 7, ten pieces of the patch identification information 104 (5 pieces of −4 to 0 on the first sheet and 5 pieces of +1 to +5 on the second sheet in this embodiment) corresponding to ten steps (levels) of the secondary transfer voltage settings are provided. Further, the chart 100 may be provided with front/back identification information 105 indicating at least one of the first side (front side) and the second side (back side) of the recording material S on at least one of the first side (front side) and the second side (back side) of the recording material S.

The size of the patch is required to be large enough to permit the operator to easily discriminate whether there is an image defect or not. For the transferability of the blue solid patch 101 and the black solid patch 102, if the size of the patch is small, it can be difficult to discriminate the defect, and therefore, the size of the patch is preferably 10 mm square or more, and when the size of the patch is 25 mm square or more, it is further preferable.

The image defects due to electric discharge which occur when the secondary transfer voltage is increased in the halftone patch 103 are often in the form of white spots. This image defect tends to be easy to discriminate even in a small size image, compared to the transferability of the solid image. However, it is easier to observe the image defect if the image is not too small, and therefore, in this embodiment, the width of the halftone patch 103 in the feeding direction is the same as the width of the blue solid patch 101 and the black solid patch 102 in the feeding direction. In addition, the interval between the patch sets 101 to 103 in the feeding direction may only be required to be set so that the secondary transfer voltage can be switched. In this embodiment, each of the blue solid patch 101 and the black solid patch 102 is a square (one side of which is substantially parallel to the widthwise direction) of 25.7 mm×25.7 mm. Further, in this embodiment, each of the halftone patches 103 at opposite end portions with respect to the width direction is 25.7 mm in width with respect to the width direction, and the widthwise direction thereof extends to an extreme end portion (which may include a margin described later). Further, in this embodiment, the interval between the patch sets 101 to 103 in the feeding direction is 9.5 mm. The secondary transfer voltage is switched at a timing when a portion on the chart 100 corresponding to this interval passes through the secondary transfer portion N2. In this embodiment, the patch sets 101 to 103 are sequentially transferred from an upstream side to a downstream side of the feeding direction of the recording material S during formation of the chart 100 by using a plurality of secondary transfer voltages made different so as to sequentially increase in absolute value. However, the present invention is not limited thereto. The patch sets 101 to 103 may also be sequentially transferred from the upstream side to the downstream side of the recording material feeding direction during the formation of the chart 100 by using the plurality of secondary transfer voltages made different so as to sequentially decrease in absolute value.

Incidentally, it is preferable to prevent patches from being formed in the neighborhood of the leading and trailing ends of the recording material S in the recording material feeding direction (for example, in the range of about 20 to 30 mm inward from the edge). The reason for this will be described. That is, of the end portions in the feeding direction of the recording material S, there may be an image defect that occurs only at the leading end or the trailing end. This is because in this case, it may be difficult to determine whether or not an image defect has occurred because the secondary transfer voltage is changed.

A size of a maximum recording material S usable in the image forming apparatus 1 of this embodiment is 13 inches (about 330 mm)×19.2 inches (about 487 mm), and the large chart 100L of FIG. 6 corresponds to the recording material S of this size. In the case where the size of the recording material S is 13 inches×19.2 inches or less and the A3 size (297 mm×420 mm) or more, a chart corresponding to image data cut out of the image data of the large chart 100L of FIG. 6 depending on the size of the recording material S is outputted. At this time, in this embodiment, the image data is cut out in conformity to the size of the recording material S on a leading end center (line) basis. That is, the image data is cut out in a manner such that the leading end of the recording material S with respect to the feeding direction and the leading end (upper end in the figure) of the large chart 100L are aligned with each other and that a center (line) of the recording material S with respect to the widthwise direction and a center (line) of the large chart 100L with respect to the widthwise direction are aligned with each other. Further, in this embodiment, the image data is cut out so that a margin of 2.5 mm is provided at each of end portions (opposite end portions with respect to each of the widthwise direction and the recording material feeding direction in this embodiment). For example, in the case where the large chart 100L is outputted on the recording material S with the A3 size (297 mm×420 mm), the image data in a range of 292 mm×415 mm is cut out by providing a margin of 2.5 mm at each of the end portions. Then, the large chart 100L corresponding to the image data is outputted on the recording material S with the A3 size (297 mm×420 mm) on the leading end center (line) basis. In the case where the recording material S of which width is smaller than 13 inches is used, a dimension of the halftone patch 103 at each of the end portions with respect to the widthwise direction becomes small. Further, in the case where the recording material S of which width is smaller than 13 inches is used, a margin at a trailing end portion with respect to the recording material feeding direction becomes small. As described above, on the large chart 100L, the 11 patch sets of −5 to 0 to +5 are disposed. The 11 sets of the patch sets 101 to 103 on the large chart 100L are disposed in a range of 387 mm with respect to the feeding direction so as to all within a length of 415 mm with respect to the feeding direction in the case where the size of the recording material S is the A3 size.

In this embodiment, in the case where the recording material S of which size is smaller than the A3 size (297 mm×420 mm) is used, the small chart 100S is outputted. The small chart 100S of FIG. 7 corresponds to sizes from an A5 size (short edge feeding) to a size smaller than the A3 size (297 mm×420 mm) (i.e., lengths from 210 mm to 419 mm in the feeding direction). As described above, on the small chart 100S, 10 patch sets consisting of 5 sets of −4 to 0 on a first sheet and 5 sets of +1 to +5 on a second sheet are disposed. The size of the image data on the small chart 100S is 13 inches×210 mm. With respect to the widthwise direction, the halftone patch 103 becomes small in conformity to the size of the recording material S. With respect to the feeding direction, the 5 patch sets are disposed so as to fall within a length of 167 mm in the feeding direction, and a margin of the trailing end portion becomes long in conformity to the length of the recording material S ranging from 210 mm to 419 mm. In the case of the recording material S with the length of 210 mm to 419 mm in the feeding direction, only the 5 patch sets can be formed on one sheet with respect to the feeding direction. For that reason, in order to increase the number of the patches, the chart is divided into those on two sheets, so that 10 patch sets consisting of the 5 patch sets of −4 to 0 and 5 patch sets of +1 to +5 are formed in total. Incidentally, in the case of the small chart 100S, the patch set of −5 provided on the large chart 100L is omitted.

Further, in this embodiment, irrespective of the size of the recording material S, the blue solid patches 101 and the black solid patches 102 are disposed so as not to overlap with each other between the first side (front side) and the second side (back side) of a double side chart on the recording material S. In this embodiment, a patch interval with respect to the widthwise direction is 5.4 mm. This is because a variation in patch density on the second side due to the influence of the patch density on the first side is suppressed and thus adjustment of the secondary transfer voltage on the second side is performed accurately.

Further, in this embodiment, not only a standard size but also an arbitrary size (free size) recording material S is usable by an operator inputting and designating through the operating portion 70 or the external device 200, so that the chart 100 can be outputted.

Here, a single chart 100 may be formed on one side (surface) of a single recording material S or on one side (surface) of each of a plurality of recording materials S (i.e., may be a single set of charts including a set of patch group changed stepwise in test voltage). In the above-described embodiment, each of the large chart 100La (first side) and the large chart 100 Lb (second side) corresponds to the single chart. Further, in the above-described embodiment, the small charts 100Sa (first side) on the first sheet and the second sheet corresponds to the single chart as a whole. Similarly, the small charts 100Sb (second side) on the first sheet and the second sheet corresponds to the single chart as a whole.

5. Operation in Adjustment Mode

Next, the operation in the adjustment mode will be described. FIG. 8 is a flowchart showing an outline of a procedure of the operation in the adjustment mode in this embodiment. Further, FIG. 9 is a schematic view showing an example of an adjusting screen 300 for making setting of the adjustment mode in this embodiment. Incidentally, in this embodiment, the case where the above-described large chart 100L is formed as the chart is described as an example. Further, in this embodiment, the case where the operator inputs an instruction from the operating portion 70 of the image forming apparatus 1 and executes the operation in the adjustment mode is described as an example. Further, for simplicity, the recording material on which the chart is formed is referred simply to as a "chart" in some instances.

The adjusting screen 300 of the operation in the adjustment mode will be described with reference to FIG. 9. In this embodiment, the controller 30 (adjustment process portion 31*d*) causes a display portion 70*a* of the operating portion 70 to display an adjustment mode setting screen 300 as shown in FIG. 9. The adjusting screen 300 has voltage setting portions 301 (301*a*, 301*b*) for setting the adjusting values of the secondary transfer voltage for the first side (front side) and the second side (back side) of the recording material S, respectively. In addition, the adjusting screen 300 has an output side selecting portion 302 for selecting whether to output the chart to one side of double (both) sides of the recording material S. Further, the adjusting screen 300 includes an output instructing portion (chart output button) 303 for providing an instruction to output the chart 100. Further, the adjusting screen 300 includes a decision portion (OK button) 304 for deciding the setting and a cancel button 305 for canceling a change setting. The controller 30 (adjustment process portion 31*d*) is capable of acquiring pieces of information on various settings inputted in the operating portion 70 through the adjusting screen 300 and then is capable of storing the pieces of information in the storing portions (the RAM 33, the secondary transfer voltage storage/operation portion 31*f*, and the like) as needed.

In this embodiment, before the chart 100 is outputted, the adjusting value displayed at the voltage setting portion 301 indicates a center voltage value (value corresponding to a patch of "0" on the chart) of the secondary transfer voltage (specifically the recording material part voltage Vp) during the formation of the chart 100. When the adjusting value of "0" is selected at the voltage setting portion 301 and the chart 100 is selected, the above-described center voltage value is set at a predetermined value (table value) set in advance for the recording material S currently selected. The adjusting value displayed at the voltage setting portion 301 can be changed by the operator. When an adjusting value other than "0" is selected and the chart 100 is outputted, the above-described center voltage value is changed with an B adjusting value ΔV of 150 V for each adjusting value of one level, and the chart 100 is outputted. Further, the chart outputting button 303 is operated, whereby the chart 100 is outputted. Then, after the output of the chart 100, at the voltage setting portion 301, the recommended adjusting value of the secondary transfer voltage determined by the controller 30 on the basis of a reading result of the chart 100 by the reading portion 80 is displayed. This adjusting value displayed at the voltage setting portion 301 can be changed by the operator. In the voltage setting portion 301, the OK button 104 is operated in a state in which the adjusting value determined by the above-described controller 30 or the adjusting value changed by the operator is selected, the adjusting value of the secondary transfer voltage is decided. Incidentally, before the output of the chart 100, the adjusting value displayed at the voltage setting portion 301 may indicate the adjusting value currently set for the recording material S currently selected.

The procedure of the operation in the adjustment mode will be described with reference to FIG. 8. First, the controller 30 (adjustment process portion 31*d*) acquires information (paper kind category, size, or the like) on the recording material S for which the operator intends to adjust the set value of the secondary transfer voltage (S201). For example, the controller 30 (adjustment process portion 31*d*) causes the display portion 70*a* of the operating portion 70 to display a recording material setting screen for making setting of the recording material S. In this recording material setting screen, input (selection) of the information (paper kind category, size or the like) on the recording material S used can be performed. Further, for example, in the recording material setting screen, an actuation button of the operation in the adjustment mode provided corresponding to each recording material S is operated by the operator. Then, the controller 30 (adjustment process portion 31*d*) causes the display portion 70*a* of the operating portion 70 to display the adjusting screen 300 for making setting of the operation in the adjustment mode as shown in FIG. 9. That is, in this embodiment, the controller 30 (adjustment process portion 31*d*) acquires the information on the recording material S in response to the operation of the actuating button of the operation in the adjustment mode by the operator, and then starts the process of the operation in the adjustment mode in which the set value of the secondary transfer voltage is adjusted in association with the information. Incidentally, for example, the information on the recording material S may also be acquired from information set in association with the recording material cassette 91 in advance, by selecting the recording material cassette 91 in which the recording material S used in the operation in the adjustment mode is accommodated.

Next, the controller 30 (adjustment process portion 31*d*) acquires a piece of information on setting of the center voltage value of the secondary transfer voltage during formation of the chart 100 and a piece of information on setting as to whether to output the one-side chart or the double-side chart, which are inputted by the operator on the adjusting screen 300 (S202). Next, when the chart outputting button 303 is operated by the operator on the adjusting screen 300, in advance of the output of the chart 100, the controller 30 (adjustment process portion 31*d*) acquires information on an electric resistance of the secondary transfer portion N2 by the operation similar to the operation in the above-described ATVC (S203). In this embodiment, as described above, a polynomial (quadratic expression in this embodiment) of two terms or more for a relationship between a voltage and a current, depending on the electric resistance of the secondary transfer portion N2 is acquired. Then, the controller 30 (adjustment process portion 31*d*) sets the secondary transfer voltage $Vtr=Vb+Vp+\Delta V$ on the basis of the acquired information on the electric resistance and the information on the above-described center voltage value set on a pre-output adjusting screen 300*a*, and then outputs the chart 100 (S204). At this time, the controller 30 (adjustment process portion 31*d*) adjusts the image data of the chart 100 depending on the size of the recording material S as described above, and carries out control so as to output the chart 100 while changing the adjusting value ΔV every 150 V. In this embodiment, the case where the large chart 100L is outputted is taken as an example, and therefore, the controller 30 (adjustment process portion 31*d*) carries out control so as to output the chart 100 including the 11 patch sets as described above. For example, in the case where the recording material part voltage Vp in an environment during execution of the operation in the adjustment mode is 2500 V and the voltage value Vb acquired in the ATVC is 1000 V, image formation of the chart 100 is carried out while changing the secondary transfer voltage from 2750 V to 4250 V with an increment of 150 V.

Next, the controller 30 (adjusting process portion 31*d*) acquires density information (brightness information) of the patch of the outputted chart 100 (S205). In this embodiment, the outputted chart 100 is set on the reading portion 80 (for example, the automatic original feeding device 81) by the operator, and is read by the reading portion 80. In the case where the double-side chart is outputted, the chart of the double-side chart on each of the first side and the second side is read by the reading portion 80. The controller 30 (adjusting process portion 31*d*) acquires RGB brightness data (8 bits) of each patch of the blue solid image on the basis of a reading result of the reading portion 80. At this time, the controller 30 (adjustment process portion 31*d*) is capable of causing the operating portion 70 to display a message prompting the operator to set the chart 100 in the reading portion 80. Further, the controller 30 (adjustment process portion 31*d*) is capable of carrying out reading of the chart 100 by controlling the reading portion 80 in response to the operation of a start button (not shown) by the operator in the operating portion 70. Next, the controller 30 (adjustment process portion 31*d*) acquires an average (value) of the brightness of each patch ("average brightness") with use of the acquired brightness data (density data) (S206). In the case where the double-side chart is outputted, the average brightness (value) is acquired for each chart of the double-side chart on the first side and the second side. By this process, for each of the first side and the second side of the recording material S, as an example, a relationship between a voltage level (adjusting value) and the average brightness of the patch as shown in FIG. 10 (i.e., information on progression of the patch density relative to the change in secondary transfer voltage) is determined. In FIG. 10, the abscissa represents the adjusting values (−5 to +5) showing associated voltage levels and the ordinate represents the average brightness of the blue solid image. Incidentally, as regards the patch for the blue solid image, brightness data for B is used.

Next, the controller 30 (adjusting process portion 31*d*) acquires a discrimination value of an appropriate secondary transfer voltage based on the acquired relationship between the adjusting value and the average brightness (S207). In this embodiment, the controller 30 (adjusting process portion 31*d*) uses, as the discrimination value of the appropriate secondary transfer voltage, the adjusting value at which the average brightness is minimum (density is maximum). That is, when an absolute value of the secondary transfer voltage is smaller than an appropriate value, the toner image cannot be transferred onto the recording material S and thus the image density becomes low in some instances ("roughening").

In this case, the resultant average brightness becomes large. On the other hand, when the absolute value of the secondary transfer voltage is larger than the appropriate value, the electric charge is injected into the toner, so that the charge polarity of the toner is changed to a polarity opposite to the normal charge polarity of the toner. For that reason, an image defect which is called "white void" or "improper transfer" such that the toner (image) once transferred on the recording material S is returned to the intermediary transfer belt 44*b* occurs in some instances. Also, in this embodiment, the image density becomes poor, so that the resultant average brightness becomes large. Accordingly, in the case of the adjusting value at which the average brightness is smallest, it can be said that the image density is highest and that the resultant secondary transfer voltage is the appropriate secondary transfer voltage. In the case where the one-side chart is outputted, on the basis of a reading result of the one-side chart, a discrimination value of the appropriate secondary transfer voltage for the one-side printing is acquired. Further, in the case where the double-side chart is outputted, on the basis of a reading result of each of the double-side chart on the first side and the second side, a discrimination value of the appropriate secondary transfer voltage for each of the first side and the second side in the double-side printing is acquired.

Then, as regards the secondary transfer voltage for the first side in the one-side printing or the double-side printing, the controller 30 (adjusting process portion 31*d*) determines, as a recommended discrimination value of the secondary transfer voltage, a discrimination value acquired on the basis of the above-described relationship between the adjusting value and the average brightness (S208).

Next, the controller 30 (adjusting process portion 31*d*) discriminates whether or not the above-described discrimination value for the second side in the double-side printing is acquired (whether or not the double-side chart is outputted) (S209). In the case where the controller 30 discriminated that the discrimination value for the second side in the double-side printing is not acquired (that the double-side chart is not outputted), the sequence goes to a process of S211. On the other hand, in the case where the controller 30 discriminated that the discrimination value for the second side in the double-side printing is acquired (that the double-side chart is outputted), the controller 30 corrects the above-described discrimination value for the secondary transfer voltage for the second side in the double-side printing and determines the recommended adjusting value of the secondary transfer voltage (S210).

Here, determination of the recommended adjusting value (correction of the discrimination value) of the secondary transfer voltage for the second side in the double-side printing in this embodiment will be described.

In this embodiment, as described above, the patches of the blue solid image for the first side and the second side of the double-side chart used in the process for determining the recommended adjusting value of the secondary transfer voltage in the operation in the adjustment mode are disposed so as not to overlap with each other between the first side (front side) and the second side (back side) of the recording material S. By this, a variation in density of the patch for the second side by the influence of the density of the patch for the first side is suppressed.

However, as described above, in some instances, the secondary transfer current when the patch of the chart on the second side is secondary-transferred fluctuates due to the presence of the patch on the first side on which the density is not uniform, i.e., the toner amount is not uniform. That is, as regards an image with an arbitrary image density outputted by the user, on the first side in the one-side printing and the double-side printing, the influence of the toner on the second side (back side) is not required to be considered. For that reason, the secondary transfer voltage is appropriately adjusted by determining, as the recommended value of the secondary transfer voltage, the discrimination value acquired on the basis of the above-described relationship between the adjusting value and the average brightness. On the other hand, as regards the second side in the double-side printing, the secondary transfer current during the secondary transfer of the image on the second side is changed by the toner amount on the first side which corresponds to the back side in this case. FIG. 11 is a graph showing an example of a relationship between a toner application amount M/S [mg/cm$^2$] on the first side and a toner part voltage (transfer voltage of an electric resistance component of the toner layer) Vt [V] on the first side during the secondary transfer of the image on the second side in the double-side printing acquired by an experiment. As shown in FIG. 11, with an increase in toner application amount on the first side, the toner part voltage Vt applied to the toner layer on the first side increases. For that reason, depending on the image density of the image outputted by the user, at the discrimination value acquired on the basis of the above-described relationship between the adjusting value and the average brightness, there is a possibility that the image defect due to the insufficient secondary transfer current occurs. Particularly, there is a possibility that the image defect becomes conspicuous under a condition such that a degree of contribution of the electric resistance of the toner layer to the electric resistances of the recording material S and the toner layer on the first side in the secondary transfer portion N2 is large (i.e., a ratio of the toner part voltage to the recording material part voltage and the toner part voltage becomes large).

Therefore, in this embodiment, in consideration of the above-described relationship, the controller 30 (adjusting process portion 31*d*) corrects, in S210, the discrimination value on the second side in the double-side printing acquired on the basis of the above-described relationship between the adjusting value and the average brightness. In this embodiment, the controller 30 (adjusting process portion 31*d*) adds, to the above-described discrimination value, a predetermined adjusting value corresponding to a predetermined correction amount [V] (this adjusting value is also referred to as a "correction value"). Particularly, in this embodiment, the controller 30 adds, to the above-described discrimination value, a correction value of +1 level so that the correction amount becomes the adjusting value +1 level. FIG. 12 is a graph schematically showing a method of determining the recommended adjusting value of the secondary transfer voltage for the second side in the double-side printing by correcting the discrimination value through addition to the above-described correction value to the discrimination value. As shown in FIG. 12, the sufficient secondary transfer current which can occur due to a variation in secondary transfer current for the second side depending on the toner amount on the first side can be supplemented by adding the above-described correction value to the above-described discrimination value. Incidentally, in this embodiment, the correction value was the adjusting value +1 level but is not limited thereto. The correction value may only be required to be set in advance by the experiment or the like so that the insufficient secondary transfer current which can occur depending on the image density of the image outputted by the user and which is for the second side in the double-side printing is supplemented.

Next, the controller 30 (adjusting process portion 31*d*) causes the display portion 70*a* of the operating portion 70 to display the recommended secondary transfer voltage determined in S208 and S210 on the adjusting screen 300 as shown in FIG. 9 (S211). As described above, after the output of the chart 100, on the voltage setting portions 301 (301*a*, 301*b*), the recommended adjusting value of the secondary transfer voltage determined by the controller 30 is displayed. On the voltage setting portion 301*a* for the front side, the adjusting value determined in S208 is displayed. On the voltage setting portion 301*b* for the back-side, the adjusting value determined in S209 is displayed. The operator is capable of discriminating whether or not the displayed adjusting value is appropriate on the basis of the display contents of the adjusting screen 300 and the outputted chart 100. The operator operates the OK button 304 on the adjusting screen 300 as it is in the case where the displayed adjusting value is not changed. On the other hand, the operator inputs a desired adjusting value to the voltage setting portion 301 (301*a*, 301*b*) of the adjusting screen 300 in the case where the operator intends to change the adjusting value from the displayed adjusting value, and then operates the OK button 304. Accordingly, the controller 30 (adjustment process portion 31*d*) discriminates whether or not the change in adjusting value is made (S212). In the case where the adjusting value is not changed and the OK button 304 is operated, the controller 30 (adjustment process portion 31*d*) causes the RAM 33 (or the secondary transfer voltage storage/operation portion 31*f*) to store the adjusting value determined in S208 and S210 (S213). On the other hand, in the case where the change in adjusting value is made, the controller 30 (adjustment process portion 31*d*) causes the RAM 33 (or the secondary transfer voltage storage/operation portion 31*f*) to store the adjusting value inputted by the operator (S214). Incidentally, in place or in addition to the adjusting value, an adjusting value ΔV to be acquired as described later may be stored. The operation in the adjustment mode is thus ended.

During execution of subsequent job in which the recording material S to be subjected to the above-described adjustment is used, the controller 30 (secondary transfer voltage storage operation portion 31*f*) sets the secondary transfer voltage depending on the adjusting value stored as described above until the adjustment is subsequently executed. That is, the controller 30 (secondary transfer voltage storage/operation portion 31*f*) sets the secondary transfer voltage for the image formation on the basis of the information on the recording material S used during the image formation and the information, corresponding to this information, stored in the above-described storing portion (RAM 33 or secondary transfer voltage storage/operation portion 31*f*). In this embodiment, the controller 30 (secondary transfer voltage storage/operation portion 31*f*) calculates the adjusting value ΔV as ΔV=(adjusting value)×150 V depending on the adjusting value stored in the operation in the adjustment mode as described above. Then, the controller 30 (secondary transfer voltage storage/operation portion 31*f*) calculates the recording material part voltage Vp+ΔV after the adjustment by using the calculated adjusting value ΔV, and calculates a secondary transfer voltage Vtr (=Vb+Vp+ΔV) for normal image formation by using this recording material part voltage (Vp+ΔV). When the double-side printing is executed, each of the secondary transfer voltages for the first side and the second side is set as described above.

6. Effect

Thus, the image forming apparatus 1 of this embodiment includes the image bearing member (intermediary transfer belt) 44*b* for bearing the toner image, the transfer member (outer secondary transfer roller) 45*b* for forming the transfer portion (secondary transfer portion) N2 for transferring the toner image from the image bearing member 44*b* to the recording material S, the applying portion (secondary transfer power source) 76 for applying the voltage to the transfer member 45*b*, the executing portion (of which function is possessed by the adjusting process portion 31*d* in this embodiment) for executing the output operation for outputting the double-side chart 100 including a first chart 100La formed by transferring a plurality of first test images onto the first side of the recording material S under application of a plurality of first test voltages to the transfer member 45*b* by the applying portion 76 and a second chart 100Lb formed by transferring a plurality of second test images onto the second side of the recording material S, on which the first chart 100La is formed, under application of a plurality of second test voltages to the transfer member 45*b* by applying portion 76, and the reading means (reading portion) 80 for acquiring information on the densities of the first test images and the second test images of the double-side chart 100. On the basis of the information acquired from the double-side chart 100 by the reading means 80, the executing portion is capable of setting the transfer voltage applied to the transfer member 45*b* by the applying portion 76 at the time of transfer in the double-side image formation in which the toner images are successively transferred onto the first side and the second side of the recording material S. Further, in this embodiment, the executing portion 31*d* executes the above-described output operation so that the first test images and the second test images do not overlap with each other on the front side and the back side of the recording material S. Further, in this embodiment, the image forming apparatus 1 includes the acquiring portion (of which function is possessed by the adjusting process portion 31*d* in this embodiment) for acquiring first information on the acquiring amount of the transfer voltage for the image transfer on the first side in the double-side image formation on the basis of information on the first test voltage and information on the density of the first test image acquired by the reading means and for acquiring second information on the acquiring amount of the transfer voltage for the image transfer on the second side in the double-side image formation on the basis of information on the second test voltage and information on the density of the second test image acquired by the reading means, the correcting portion (of which function is possessed by the adjusting process portion 31*d* in this embodiment) for acquiring third information on the acquiring amount of the secondary transfer voltage for the image transfer on the second side in the double-side image formation by correcting the second information with use of correction information, and the setting portion (of which function is possessed by the secondary transfer voltage storage/operation portion 31*f*) for setting the transfer voltage for the image transfer on the first side in the double-side image formation on the basis of the first information and for setting the transfer voltage for the image transfer on the second side in the double-side image formation on the basis of the third information. Further, in this embodiment, the image forming apparatus 1 includes the output portion (controller) 30 for outputting signals for displaying the first information and the third information. Further, in this embodiment, the image forming apparatus 1 includes the storing portion (RAM 33 or secondary transfer voltage storage/operation portion 31*f*) for storing the first information and the third information.

Further, in this embodiment, the correcting portion 31*d* acquires the correction information so that an absolute value of the transfer voltage for the image transfer on the second side in the double-side image formation is increased. Incidentally, also, a constitution in which the correcting portion 31*d* acquires the correction information so that the absolute value of the transfer voltage for the image transfer on the second side in the double-side image formation is decreased may be employed. That is, in the above-described embodiment, the possibility that the image defect due to the insufficient secondary transfer current occurs due to the variation in transfer current during the image transfer on the second side was described, but there is also a possibility that the image defect occurs due to the excessive transfer current as described above. For that reason, depending on the constitution of the image forming apparatus 1 or the like, the correction may be made so as to suppress that the image defect due to the excessive transfer voltage occurs due to the variation in transfer current during the image transfer on the second side.

Further, in this embodiment, the acquiring portion 31*d* acquires the first information on the basis of the information on the first test voltage for the transfer of the first test image, of the plurality of first test images, for which the information on the density acquired by the reading means 80 coincides with a preset image condition, and acquires the second information on the basis of the information on the second test voltage for the transfer of the second test image, of the plurality of second test images, for which the information on the density acquired by the reading means 80 coincides with a preset second condition. Typically, the first condition and the second condition are the same. In this embodiment, the first condition and the second condition are such that an average density is maximum (i.e., the average brightness is minimum). Further, in this embodiment, the image forming apparatus 1 includes the input portion (operating portion 70, acquiring screen 300) for inputting information on the adjusting amount of the transfer voltage for the image transfer on at least one of the first side and the second side in the double-side image formation in response to the operation by the operator when the output operation is executed, and in the case where the information on the adjusting amount of the transfer voltage for the image transfer on the second side in the double-side image formation is inputted from the input portion, the setting portion 31*f* sets the transfer voltage for the image transfer on the second side in the double-side image formation on the basis of the inputted information.

As described above, according to this embodiment, in the operation in the adjustment mode, the patches of the blue solid image on the first side and the second side of the double-side chart are disposed so as not to overlap with each other. By this, it is possible to suppress that the density of the patch on the second side is fluctuated by the influence of the density of the patch on the first side. Further, according to this embodiment, in the operation in the adjustment mode, the recommended adjusting value of the secondary transfer voltage for the second side in the double-side printing is determined by adding the predetermined correction value to the discrimination value acquired on the basis of the acquired relationship between the adjusting value and the average brightness. That is, the discrimination value is corrected so as to make up for the insufficient secondary transfer current during the image transfer on the second side in the double-side printing, which can occur depending on the image density of the image outputted by the user, so that the recommended adjusting value of the secondary transfer voltage for the second side in the double-side printing is determined. By this, it is possible to suppress that the insufficient secondary transfer current occurs due to the influence of the toner part voltage by the toner on the first side during the image transfer on the second side in the double-side printing. Accordingly, according to this embodiment, the secondary transfer voltage for the second side in the double-side printing can be appropriately set.

Incidentally, a method of acquiring the discrimination value of the secondary transfer voltage (adjusting value) is not limited to the above-described method. In this embodiment, the discrimination value is acquired on the basis of extraction of the adjusting value at which the average brightness is minimum (the density is maximum), but the present invention is not limited thereto. For example, a representative adjusting value such as a center value of the adjusting values at which the average brightness is the predetermined value or less may be determined as the recommended adjusting value of the secondary transfer voltage. Further, the discrimination value may be acquired on the basis of extraction of the adjusting value in a stable brightness region in which standard deviation of the average brightness values successively acquired for each of a predetermined number of the adjusting values or in a stable brightness region in which a difference in patch brightness between adjacent adjusting values is a predetermined value or less.

The discrimination value may only be required on the basis of the information on the relationship between the secondary transfer voltage and the patch density (brightness) during formation of patches.

In the above-described embodiment, the brightness data was acquired using the blue solid patch of which color is a multiple color (multiple order color), but the color of the patch is not limited to blue. For example, in place of blue, red or green which are secondary colors may be used, and a single color such as yellow, magenta, cyan or black may also be used. Further, a halftone patch may be used.

Further, in the above-described embodiment, as the reading means, the reading portion 80 for reading the chart 100 set by the operator as shown in FIG. 1 was used, but the present invention is not limited to such an embodiment. As the reading means, a reading portion for reading the chart 100 when the chart 100 is outputted from the image forming apparatus 1 may be used. For example, as shown in FIG. 13, an in-line image sensor 86 may be provided on a side downstream of the fixing portion 46 with respect to the feeding direction of the recording material S. In this case, when the chart 100 is outputted from the image forming apparatus 1, the chart 100 is read by this image sensor 86, so that density information (brightness information) of the patch can be acquired.

Thus, the reading means may acquire the information on the density of the test image of the chart 100 on the recording material S outputted from the image forming apparatus 1. Or, the reading means may also acquire the information on the density of the test image of the chart 100 on the recording material S when the recording material S on which the chart 100 is formed is outputted from the image forming apparatus 1.

Embodiment 2

Next, another embodiment of the present invention will be described. The basic structure and operation of an image forming apparatus of this embodiment are the same as those of the image forming apparatus of the embodiment 1. Therefore, as to the image forming apparatus of this embodiment, elements including the same or corresponding functions or structures as those of the image forming apparatus of the embodiment 1 are denoted by the same reference numerals or symbols as those of the embodiment 1, and detailed description thereof will be omitted.

In the embodiment 1, in the operation in the adjustment mode, the recommended adjusting value of the secondary transfer voltage for the second side in the double-side printing was determined by adding the predetermined correction value to the discrimination value of the secondary transfer voltage (adjusting value) based on the acquired relationship between the adjusting value and the average brightness. This correction value was set in advance so as to make up for the insufficient secondary transfer current, during the secondary transfer of the image on the second side in the double-side printing, which can occur depending on the image density of the image outputted by the user. Particularly, in the embodiment 1, to the discrimination value based on the relationship between the adjusting value and the average brightness, the correction value of the +1 level is added so that the correction amount [V] becomes the adjusting value +1 level, so that the recommended adjusting value of the secondary transfer voltage for the second side in the double-side printing was determined.

Here, FIG. 14 is a graph showing an example of a relationship between the recording material part voltage Vp for the secondary transfer of the image on the second side in the double-side printing and the toner part voltage Vt by the toner on the first side. As shown in FIG. 14, with a decrease in recording material part voltage Vp, the toner part voltage Vt becomes large. That is, under a condition in which the recording material part voltage Vp becomes small, contribution of the electric resistance of the toner layer to the electric resistances of the recording material S in the secondary transfer portion N2 and the toner layer on the first side becomes large. For that reason, under the above-described condition, there is a possibility that a difference between the adjusting value of the secondary transfer voltage for the second side in the double-side printing determined in the operation in the adjustment mode and the appropriate adjusting value of the secondary transfer voltage for an arbitrary image outputted by the user becomes large. For example, as the condition in which the recording material part voltage Vp becomes small, it is possible to cite thin paper small in basis weight (or thickness), an operation (use) environment of a high temperature and a high humidity. As a result, in the above-described condition, under the contact in the embodiment 1, the toner part voltage Vt cannot be completely supplemented during the secondary transfer of the image on the second side in the double-side printing, so that there is a possibility that the image defect due to the insufficient secondary transfer current occurs.

Therefore, in this embodiment, the secondary transfer voltage for the second side in the double-side printing is corrected depending on the recording material part voltage Vp and further the toner part voltage for the first side.

FIG. 15 is a flowchart showing an outline of a procedure for setting the secondary transfer voltage when the double-side printing is executed in this embodiment. Incidentally, in this embodiment, an entire operation in which the ATVC is executed when the double-side printing is executed and in which the secondary transfer voltage for each of the first side and the second side in the double-side printing is set by using a result of the ATVC and the adjusting value set in the operation in the adjustment mode is similar to the operation in the embodiment 1. Further, a general operation in the adjustment mode is roughly similar to the operation in the adjustment mode in the embodiment 1. However, in this embodiment, as regards all the first side in the one-side printing, the first side in the double-side printing, and the second side in the double-side printing, the discrimination value based on the relationship between the adjusting value and the average brightness, which is acquired as described in the embodiment 1 is determined and stored as the adjusting value of the secondary transfer voltage.

When the job of the double-side printing is started, the controller 30 (secondary transfer voltage storage/operation portion 31*f*) not only executes the ATVC but also acquires the information on the adjusting value (discrimination value) stored in the RAM 33 (or the secondary transfer voltage storage/operation portion 31*f*) (S301). At this time, the controller 30 (adjusting process portion 31*d*) acquires the information on the adjusting value (discrimination value) corresponding to the information on the recording material S designated in the double-side printing. Incidentally, in the case where the operation in the adjustment mode is not executed before the job of the double-side printing, the stored adjusting value (the discrimination value in this case) is "0". Incidentally, in the case where the operation in the adjustment mode is not executed before the job of the double-side printing, the process of the setting of the secondary transfer voltage as described in this embodiment may be omitted from description, and the image formation may be carried out using the default secondary transfer voltage.

Next, the controller 30 (secondary transfer voltage storage/operation portion 31*f*) sets the secondary transfer voltage Vtr for the first side by using the adjusting value (discrimination value) determined in the operation in the adjustment mode similarly as in the manner described in the embodiment 1 (S302). That is, the adjusting value ΔV is calculated A ΔV=(adjusting value)×150 [V]. Then, the recording material part voltage Vp+ΔV after the adjustment is calculated using the calculated adjusting value ΔV, and then the secondary transfer voltage Vtr (=Vb+Vp+ΔV) is calculated using the recording material part voltage Vp+ΔV.

On the other hand, the controller 30 (secondary transfer voltage storage/operation portion 31*f*) sets the secondary transfer voltage Vtr for the second side by correcting and using the adjusting value (discrimination value) determined in the operation in the adjustment mode, in the following manner (S303). That is, in this embodiment, the controller 30 (adjusting process portion 31*d*) calculates the adjusting value after the adjustment by adding, to the discrimination value of the secondary transfer voltage for the second side in the double-side printing determined in the operation in the adjustment mode, a value obtained by multiplying the adjusting value +1 level by Vt/Vp. Here, Vt represents the toner part voltage by the toner on the first side during the secondary transfer of the image on the second side, Vp represents the recording material part voltage during the secondary transfer of the image on the second side, and Vt/Vp represents a ratio of the toner part voltage Vt by the toner on the first side to the recording material part voltage Vp during the secondary transfer of the image on the second side. Then, the controller 30 (secondary transfer voltage storage/operation portion 31*f*) sets the secondary transfer voltage Vtr similarly as described in the embodiment 1 by using the calculated adjusting value after the adjustment. That is, the adjusting amount ΔV is calculated as ΔV= (adjusting value after correction)×150 [V]. Then, the controller 30 calculates the recording material part voltage Vp+ΔV after the adjustment by using the calculated adjusting amount ΔV, and then calculates the secondary transfer voltage Vtr (=Vb+Vp+ΔV) by using this recording material part voltage (Vp+ΔV).

Then, the controller 30 (image forming process portion 31*c*) performs the image forming operation (secondary transfer) by using the above-set secondary transfer voltage Vtr for each of the first side and the second side (S304).

Incidentally, in this embodiment, although illustration is omitted, the secondary transfer voltage Vtr for the one-side printing is set similarly as in the case of the secondary transfer voltage Vtr for the first side in the double-side printing.

Here, the controller 30 (adjusting process portion 31*d*) is capable of acquiring Vp and Vt used for acquiring the adjusting value of the secondary transfer voltage in the following manner. In this embodiment, the controller 30 (adjusting process portion 31*d*) makes reference to the recording material part voltage Vp from the table data which is stored in the ROM 32 in advance and which is as shown in FIG. 5. That is, on the basis of the information on the recording material S used in the job of the double-side printing and the environment information, the controller 30 (adjusting process portion 31*d*) acquires the corresponding recording material part voltage Vp from the table data as shown in FIG. 5. Further, in this embodiment, the controller 30 (adjusting process portion 31*d*) makes reference to the toner part voltage Vt from information (table data or calculation formula) for acquiring the toner part voltage, stored in the ROM 32 in advance, on the basis of the relationships of FIGS. 11 and 14. That is, the controller 30 (adjusting process portion 31*d*) acquires the toner application amount on the first side for the secondary transfer of the image on the second side, on the basis of information of the image on the first side. This toner application amount is acquired (for example, as an average) on the basis of the information of the image formed on the first side of all or part of the recording materials S in the job of the double-side printing, for example, and can be used for setting the secondary transfer voltage for the second sides of all the recording materials S in the job. Or, this toner application amount is acquired (for example, as the average) on the basis of the information of the image formed on the first side of each of the recording materials S in the job of the double-side printing, for example, and can be used for setting the secondary transfer voltage for the second side of each of the corresponding recording materials S. The toner application amount on the first side may also be acquired for a predetermined region including at least a part of a region in which the toner image is transferred onto the second side. Further, on the basis of the information (table data or calculation formula) indicating the relationship between the recording material part voltage Vp and the toner part voltage Vt as shown in FIG. 14 acquired in advance for each toner application amount (which may be each section of a predetermined toner application amount), the controller 30 (adjusting process portion 31*d*) acquires the recording material part voltage Vp acquired as described above and the toner part voltage Vt corresponding to the toner application amount. Then, the controller 30 (adjusting process portion 31*d*) acquires the Vt/Vp ratio by using these voltages Vp and Vt.

Incidentally, in this embodiment, the adjusting value of the secondary transfer voltage for the second side in the double-side printing was acquired depending on the Vt/Vp ratio. In this case, the recording material part voltage Vp includes first and second values, in which the adjusting value when the recording material part voltage Vp is the second value smaller in absolute value than the first value is larger than the adjusting value when the recording material part voltage Vp is the first value. The toner part voltage Vt includes third and fourth values, in which the adjusting value when the toner part voltage Vt is the fourth value larger than the third value is larger than the adjusting value when the toner part voltage Vt (absolute value) is the third value. However, the present invention is not limited thereto. For example, the toner part voltage Vt for the first side is regarded as substantially constant (predetermined value), and the adjusting value of the secondary transfer voltage for the second side in the double-side printing may be acquired depending on the recording material part voltage Vp. In this case, the adjusting value when the recording material part voltage Vp is the second value smaller than the first value is larger than the adjusting value when the recording material part voltage Vp (absolute value) is the first value. This corresponds to acquisition of the adjusting value of the secondary transfer voltage for the second side in the double-side printing depending on the Vt/Vp ratio using the toner part voltage Vt which is regarded above as substantially constant. Further, for example, the recording material part voltage Vp is regarded as substantially constant (predetermined value) in the case where a predetermined recording material S (thin paper with a basis weight in a predetermined range) is used or in the case of a predetermined environment (high temperature/high humidity environment or the like). In this case, the adjusting value when the toner part voltage Vt is the fourth value than the third value. This corresponds to acquisition of the adjusting value of the secondary transfer voltage for the second side in the double-side printing depending on the Vt/Vp ratio using the recording material part voltage Vp regarded above as substantially constant.

Thus, in this embodiment, the image forming apparatus 1 includes an output portion for outputting a signal for displaying the above-described first information and second information. Further, in this embodiment, when the double-side image formation is executed, the setting portion 31*f* sets the transfer voltage for the image transfer on the second side on the basis of the above-described third information acquired by the correcting portion 31*d*. Further, in this embodiment, the image forming apparatus 1 includes the storing portion (RAM 33 or secondary transfer voltage storage/operation portion 31*f*) for storing the above-described first information and second information. Further, in this embodiment, when the double-side image formation is executed, the setting portion 31*f* sets the transfer voltage for the image transfer on the second side on the basis of the above-described third information acquired by the correcting portion 31*d*. The correcting portion 31*d* is capable of acquiring correction information on the basis of information on the recording material S on which the images are formed on the first side and the second side (on both sides). In this case, the correcting portion 31*d* acquires the correction information so that an absolute value of a correcting amount indicated by correction information in the case where the absolute value of the recording material part voltage is the second value smaller than the first value becomes larger than an absolute value of a correcting amount indicated by information in the case where an absolute value of the recording material part voltage, based on the information on the recording material S, applied to the recording material S in the transfer portion N2 during the image transfer on the second side. Incidentally, the recording material part voltage is capable of being acquired in advance on the basis of a kind (basis weight, thickness or the like) of the recording material S, and further environment information (at least one of the temperature and the humidity on at least one of an inside and an outside of the image forming apparatus 1). Further, the recording material part voltage may be acquired by being measured in the image forming apparatus 1. For example, when the recording material S is in the transfer portion N2, a value of a current flowing through the recording material S under application of a predetermined transfer voltage Vtr to the transfer portion N2 can be measured. This can be carried out, for example, when a marginal portion of the recording material S on a leading end side of the recording material S with respect to the recording material feeding direction is in the transfer portion N2 during the formation of the image on the first side or the second side. Further, a transfer portion part voltage Vb is acquired by the above-detected current value to a relationship between the voltage and the current when there is no recording material S in the transfer portion N2. Further, the recording material part voltage Vp can be acquired by subtracting the above-acquired transfer portion part voltage Vb from the above-described toner part voltage Vt. Further, as the information on the recording material S, information on an electric resistance of the recording material S may be used. There is a correlation between the electric resistance of the recording material S and the recording material part voltage, and the recording material part voltage is relatively high in the case where the electric resistance of the recording material S is relatively high, and is relatively low in the case where the electric resistance of the recording material S is relatively low. The recording material part voltage can be regarded as information on the electric resistance of the recording material S. Further, the correcting portion 31*d* is capable of acquiring the correction information on the basis of the information on the toner amount of the toner image transferred onto the first side in the double-side image formation. In this case, the correcting portion 31*d* acquires the correction information so that an absolute value of a correcting amount indicated by correction information when the absolute value of the toner part voltage is the fourth value larger than the absolute value of the third value becomes larger than the absolute value of the correction amount indicated by correction information when the absolute value of the toner part voltage, based on the information on the toner amount, applied to the toner on the first side in the transfer portion N2 during the image transfer on the second side.

As described above, according to this embodiment, in accordance with the recording material S or the image on the first side when the double-side printing is executed, the secondary transfer voltage for the second side in the double-side printing can be set appropriately.

Other Embodiments

As described above, the present invention was described based on specific embodiments, but is not limited to the above-described embodiments.

Further, in the above-described embodiments, the transfer voltage was adjusted by using the adjusting value corresponding to the predetermined adjusting value, but the adjusting value may also be directly set through the adjusting screen, for example.

Further, in the above-described embodiments, the image forming apparatus has the constitution in which the information on the adjusting amount of the transfer voltage determined by the image forming apparatus in the operation in the adjustment mode can be changed by the operator, but may employ a constitution in which such information cannot be changed.

Further, in the above-described embodiments, the operation performed at the operating portion of the image forming apparatus can also be performed by the external device. That is, the case where the operation in the adjustment mode is executed by the operation through the operating portion 70 of the image forming apparatus 1 by the operator was described, but the operation in the adjustment mode may also be executed by the operation through the external device 200 such as the personal computer. In this case, setting similar to the setting in the above-described embodiments can be made through a screen displayed on the display portion of the external device 200 by a driver program for the image forming apparatus 1 installed in the external device 200.

Further, in the above-described embodiments, the constitution in which the secondary transfer voltage was subjected to the constant-voltage control was described, but the secondary transfer voltage may also be subjected to the constant-current control. In the above-described embodiments, in the constitution in which the secondary transfer voltage was subjected to the constant-voltage contact, the secondary transfer was adjusted by adjusting the target voltage under application of the secondary transfer voltage in the operation in the adjustment mode.

Further, each of the current detection result and the voltage detection result may be an average of a plurality of sampling values acquired in a predetermined sampling interval at a certain detection timing. Further, in the case where the transfer voltage is subjected to the constant-voltage contact, the voltage value may be detected (recognized) from an output instruction value to the power source. In the case where the transfer voltage is subjected to the constant-current contact, the current value may be detected (recognized) from the output instruction to the power source.

Further, the present invention is not limited to the image forming apparatus of the tandem type, but is also applicable to image forming apparatuses other types. In addition, the image forming apparatus is not limited to the color image forming apparatus, but may also be a monochromatic image forming apparatus. For example, the present invention may be applied to a transfer portion in the image forming apparatus having a constitution in which the toner image is formed on the photosensitive drum as the image bearing member and then is directly transferred onto the recording material in the transfer portion. Further, the present invention can be carried out in various uses, such as printers, various printing machines, copying machines, facsimile machines, and multi-function machines.

According to the present invention, it becomes possible to appropriately set the secondary transfer voltage for the second side in the double-side printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-079387 filed on May 7, 2021, which is hereby incorporated by reference herein in its entirety.

What is claimed is:

1. An image forming apparatus comprising:

an image forming portion configured to form a toner image;

a transfer portion configured to transfer, onto a recording material, the toner image formed by said image forming portion;

a power source configured to apply a voltage to said transfer portion;

a reading portion configured to read an image on the recording material; and a controller configured to execute an output operation for outputting a double-side chart including a first chart formed by transferring a plurality of first test images onto a first side of the recording material under application of a plurality of first test voltages from said power source to said transfer portion and a second chart formed by transferring a plurality of second test images onto a second side of the recording material under application of a plurality of second test voltages from said power source to said transfer portion, and configured to execute an operation in a mode in which a transfer voltage for image transfer onto a first side in a double-side image formation is set on the basis of a detection result of said plurality of first test images read by said reading portion and in which a transfer voltage for image transfer onto a second side in the double-side image formation is set on the basis of a detection result of said plurality of second test images read by said reading portion, wherein said controller executes the output operation so that said plurality of first test images do not overlap with said plurality of second test images, respectively, on the first side and the second side of the recording material, wherein said controller is configured to execute a predetermined selecting operation in which one image of a plurality of images is selected on the basis of a detection result when the plurality of images are detected by said reading portion, wherein said controller selects one first test image of said plurality of first test images by the predetermined selecting operation and sets the transfer voltage for the image transfer onto the first side in the double-side image formation on the basis of the selected first test image in a case in which the transfer voltage for the image transfer on the first side in the double-side image formation is set in the operation in the mode, and wherein said controller selects one second test image of said plurality of second test images by the predetermined selecting operation and sets a voltage, of which an absolute value is greater than that of the test voltage when the selected second test image is transferred, as the transfer voltage for the image transfer onto the second side in the double-side image formation, regardless of the detection result of said plurality of first test images by said reading portion, on the basis of the selected second test image in a case in which the transfer voltage for the image transfer onto the second side in the double-side image formation is set in the operation in the mode.

2. An image forming apparatus according to claim 1, wherein said controller sets the transfer voltage for the image transfer onto the second side in the double-side image formation on the basis of the selected second test image and an adjusting value obtained by adding a predetermined value to the test voltage applied when the selected second test image is transferred.

3. An image forming apparatus according to claim 2, wherein the predetermined value corresponds to one level when the test voltage is changed at a plurality of levels in the operation in the mode.

4. An image forming apparatus according to claim 1, further comprising an input portion configured to input information for adjusting the transfer voltage for the image transfer onto at least one of the first side and the second side in the double-side image formation, in response to an operation by an operator, wherein in a case in which the information for adjusting the transfer voltage for the image transfer on the second side in the double-side image formation is inputted from said input portion, said controller sets, as the transfer voltage for the image transfer onto the second side, the transfer voltage adjusted by the operator through said input portion.

* * * * *